US011789389B2

(12) United States Patent
Saitoh

(10) Patent No.: US 11,789,389 B2
(45) Date of Patent: Oct. 17, 2023

(54) PRESSING DEVICE, FIXING DEVICE, AND IMAGE FORMING APPARATUS

(71) Applicant: Seiji Saitoh, Kanagawa (JP)

(72) Inventor: Seiji Saitoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/965,211

(22) Filed: Oct. 13, 2022

(65) Prior Publication Data

US 2023/0244167 A1 Aug. 3, 2023

(30) Foreign Application Priority Data

Jan. 28, 2022 (JP) ..... 2022-012203

(51) Int. Cl.
*G03G 15/20* (2006.01)

(52) U.S. Cl.
CPC ..... *G03G 15/2064* (2013.01)

(58) Field of Classification Search
CPC ..... G03G 15/2064
See application file for complete search history.

(56) References Cited

U.S. PATENT DOCUMENTS

| | | | | |
|---|---|---|---|---|
| 2,496,357 | A * | 2/1950 | Rainey | B41J 7/02 101/46 |
| 5,444,906 | A * | 8/1995 | Korsunsky | H01R 43/205 29/758 |
| 10,852,678 | B1 * | 12/2020 | Inomata | G03G 15/2064 |
| 2003/0094824 | A1 * | 5/2003 | Cox | B25B 5/08 294/104 |
| 2018/0112762 | A1 | 4/2018 | Nieda | |
| 2018/0224779 | A1 | 8/2018 | Tomita et al. | |
| 2020/0172359 | A1 | 6/2020 | Nanno et al. | |

FOREIGN PATENT DOCUMENTS

| | | | | |
|---|---|---|---|---|
| JP | 2005126235 | A * | 5/2005 | B41J 13/103 |
| JP | 2007-025349 | | 2/2007 | |
| JP | 2015-009944 | | 1/2015 | |
| JP | 2017-116877 | | 6/2017 | |
| JP | 2017-151319 | | 8/2017 | |
| JP | 2018-002358 | | 1/2018 | |
| JP | 2018-028584 | | 2/2018 | |
| JP | 2018-072792 | | 5/2018 | |
| JP | 2018-123951 | | 8/2018 | |
| JP | 2018-159809 | | 10/2018 | |

* cited by examiner

*Primary Examiner* — Sevan A Aydin
(74) *Attorney, Agent, or Firm* — Harness, Dickey & Pierce, P.L.C.

(57) ABSTRACT

A pressing device includes a pressure lever that is platy and has a thickness t. The pressure lever pivots. A cam presses the pressure lever. A cam follower is mounted on the pressure lever and disposed opposite the cam. The cam follower transmits pressure from the cam to the pressure lever. The cam follower has a contact face that contacts the cam and a side face that is perpendicular to the contact face. The contact face has a length W in a thickness direction of the pressure lever and a length L1 in an orthogonal direction perpendicular to the thickness direction of the pressure lever. The length L1 is defined from a contact position where the cam follower contacts the cam to the side face of the cam follower. The thickness t, the length W, and the length L1 satisfy a relation defined by $$L1 \geq 0.6 \times (W-t)/2+0.2.$$

17 Claims, 18 Drawing Sheets

PRESSING DEVICE, FIXING DEVICE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2022-012203, filed on Jan. 28, 2022, in the Japan Patent Office, the entire disclosure of which is hereby incorporated by reference herein.

BACKGROUND

Technical Field

Embodiments of this disclosure relate to a pressing device, a fixing device, and an image forming apparatus.

Related Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data.

Such image forming apparatuses include a fixing device including a heating roller and a pressure roller that are pressed against each other to form a fixing nip therebetween.

As a recording medium bearing an image is conveyed through the fixing nip, the heating roller and the pressure roller fix the image on the recording medium under heat and pressure. The fixing device further includes a contact and separation mechanism that brings the pressure roller into contact with the heating roller and separates the pressure roller from the heating roller.

SUMMARY

This specification describes below an improved pressing device. In one embodiment, the pressing device includes a pressure lever that is platy and has a thickness t. The pressure lever pivots. A cam presses the pressure lever. A cam follower is mounted on the pressure lever and disposed opposite the cam. The cam follower transmits pressure from the cam to the pressure lever. The cam follower has a contact face that contacts the cam and a side face that is perpendicular to the contact face. The contact face has a length W in a thickness direction of the pressure lever and a length L1 in an orthogonal direction perpendicular to the thickness direction of the pressure lever. The length L1 is defined from a contact position where the cam follower contacts the cam to the side face of the cam follower. The thickness t, the length W, and the length L1 satisfy a relation defined by $$L1 \geq 0.6 \times (W-t)/2+0.2.$$

This specification further describes an improved fixing device. In one embodiment, the fixing device includes a first rotator and a second rotator that separably presses against the first rotator. The first rotator and the second rotator sandwich and convey a recording medium. A pressure lever is platy and has a thickness t. The pressure lever pivots. The pressure lever presses the second rotator against the first rotator. A cam presses and moves the pressure lever between a pressing position where the second rotator presses against the first rotator and a pressure release position where the second rotator releases pressure applied to the first rotator. A cam follower is mounted on the pressure lever and disposed opposite the cam. The cam follower transmits pressure from the cam to the pressure lever. The cam follower has a contact face that contacts the cam and a side face that is perpendicular to the contact face. The contact face has a length W in a thickness direction of the pressure lever and a length L1 in an orthogonal direction perpendicular to the thickness direction of the pressure lever. The length L1 is defined from a contact position where the cam follower contacts the cam to the side face of the cam follower. The thickness t, the length W, and the length L1 satisfy a relation defined by $L1 \geq 0.6 \times (W-t)/2+0.2$.

This specification further describes an improved image forming apparatus. In one embodiment, the image forming apparatus includes an image bearer that bears an image and the fixing device described above that fixes the image on a recording medium.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
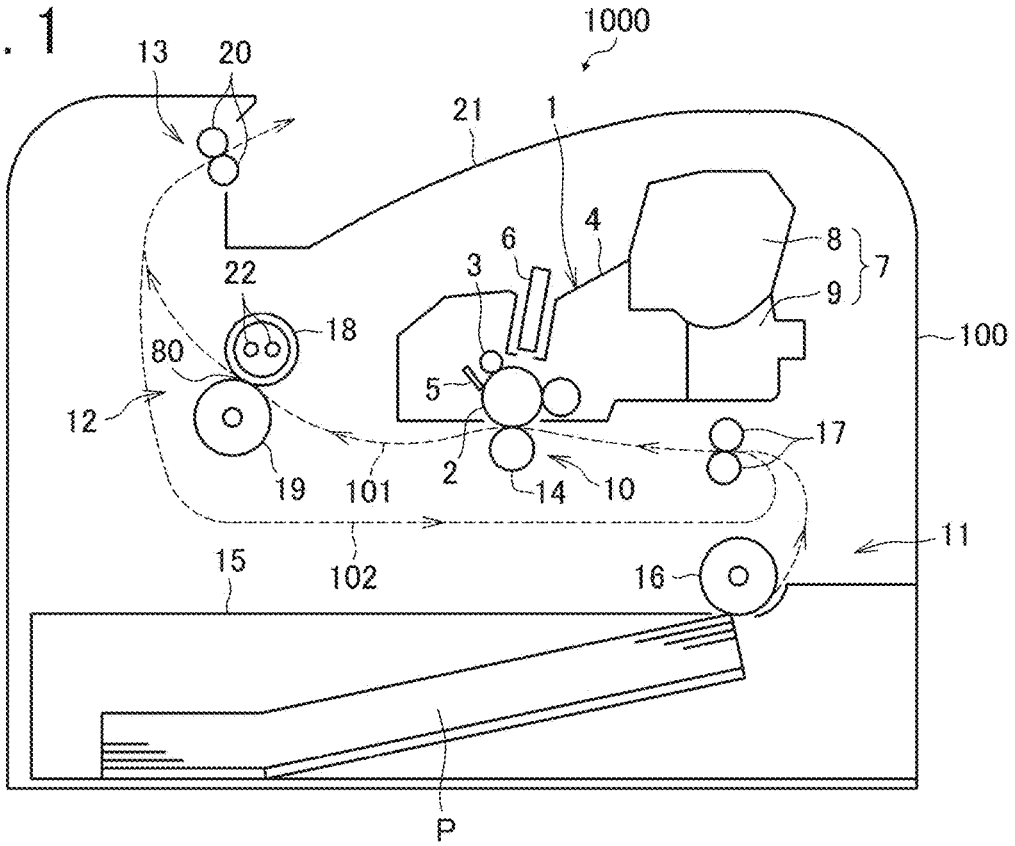
FIG. 1 is a schematic cross-sectional view of a monochrome image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

Referring to drawings, a description is provided of a construction of a fixing device and an image forming apparatus according to embodiments of the present disclosure. The technology of the present disclosure is not limited to the embodiments described below and may be modified within scopes suggested by those skilled in art with other embodiments, addition, modification, deletion, and the like. The technology of the present disclosure encompasses various embodiments that achieve operations and advantages of the embodiments of the present disclosure.

The fixing device has a construction that is applied to an image forming apparatus employing an electrophotographic method or an inkjet method. The following describes the construction of the fixing device that is installed in the image forming apparatus employing the electrophotographic method. If the fixing device is installed in the image forming apparatus employing the inkjet method, the fixing device is used as a dryer including a heating roller that heats a recording medium bearing ink, thus drying the ink, for example.

According to the embodiments below, a sheet is used as a recording medium.

However, the recording medium is not limited to paper as the sheet. In addition to paper as the sheet, the recording media include an overhead projector (OHP) transparency, cloth, a metal sheet, plastic film, and a prepreg sheet pre-impregnated with resin in carbon fibers. The recording media also include a medium adhered with a developer and ink, recording paper, and a recording sheet. In addition to plain paper, the sheets include thick paper, a postcard, an envelope, thin paper, coated paper, art paper, and tracing paper.

Image formation described below denotes forming an image having meaning such as characters and figures and an image not having meaning such as patterns on a medium.

FIG. 1 is a schematic cross-sectional view of an image forming apparatus 1000 according to an embodiment of the present disclosure.

Referring to FIG. 1, a description is provided of an overall construction and operations of the image forming apparatus 1000.

The image forming apparatus 1000 according to the embodiments of the present disclosure is a printer. Alternatively, the image forming apparatus 1000 may be a copier, a facsimile machine, a multifunction peripheral (MFP) having at least two of copying, printing, facsimile, scanning, and plotter functions, or the like.

The image forming apparatus 1000 illustrated in FIG. 1 is a monochrome image forming apparatus that forms a monochrome toner image. The image forming apparatus 1000 includes an apparatus body 100 removably installed with a process unit 1 serving as an image forming unit. The process unit 1 includes a photoconductor 2, a charging roller 3, a developing device 4, and a cleaning blade 5. The photoconductor 2 serves as an image bearer that bears an image (e.g., an electrostatic latent image and a toner image) on a surface of the photoconductor 2. The charging roller 3 serves as a charger that charges the surface of the photoconductor 2. The developing device 4 serves as a developing unit that visualizes an electrostatic latent image formed on the surface of the photoconductor 2 as a toner image. The cleaning blade 5 serves as a cleaner that cleans the surface of the photoconductor 2. The image forming apparatus 1000 further includes a light-emitting diode (LED) head array 6 that is disposed opposite the photoconductor 2 and serves as an exposure device that exposes the surface of the photoconductor 2.

The image forming apparatus 1000 further includes a toner cartridge 7 that is removably mounted on the process unit 1 and serves as a powder container that contains toner as particles used to form the toner image. The toner cartridge 7 includes a fresh toner container 8 that contains fresh toner (e.g., unused toner) and a waste toner container 9 that contains waste toner (e.g., used toner).

The image forming apparatus 1000 further includes a transfer device 10, a sheet feeder 11, a fixing device 12, an output device 13, and a registration roller pair 17. The transfer device 10 transfers the toner image onto a sheet P serving as a recording medium.

The sheet feeder 11 supplies the sheet P to the transfer device 10. The fixing device 12 fixes the toner image transferred onto the sheet P thereon. The output device 13 ejects the sheet P onto an outside of the apparatus body 100. The registration roller pair 17 serves as a timing roller pair.

The transfer device 10 includes a transfer roller 14 serving as a transferor. The transfer roller 14 contacts the photoconductor 2 in a state in which the process unit 1 is installed in the apparatus body 100. The transfer roller 14 is coupled to a power supply that applies at least one of a predetermined direct current (DC) voltage and a predetermined alternating current (AC) voltage to the transfer roller 14.

The sheet feeder 11 includes a sheet tray 15 (e.g., a paper tray) that loads a plurality of sheets P serving as recording media and a feed roller 16 that picks up and feeds a sheet P from the sheet tray 15. In addition to plain paper, the sheets P include thick paper, thin paper, a postcard, an envelope, coated paper, art paper, and tracing paper. Further, instead of paper, an OHP transparency (e.g., an OHP sheet and OHP film) and the like may be used as recording media.

The fixing device 12 includes a pair of rotators, that is, two rotators that are disposed opposite each other. One of the rotators is a fixing roller 18 serving as a fixing rotator that fixes the toner image on the sheet P. Another one of the rotators is a pressure roller 19 serving as a pressure rotator that presses against the fixing roller 18. The fixing device 12 further includes heaters 22 (e.g., halogen heaters) that are disposed inside the fixing roller 18. The fixing roller 18 and the pressure roller 19 contact each other to form a fixing nip 80 therebetween.

The output device 13 includes an output roller pair 20 that ejects the sheet P onto the outside of the apparatus body 100. The image forming apparatus 1000 further includes an output tray 21 that is disposed on a top face of an exterior of the apparatus body 100 and is placed with the sheet P ejected by the output roller pair 20.

The apparatus body 100 accommodates a conveyance path 101 and a duplex conveyance path 102. The conveyance path 101 extends from the sheet tray 15 to the output roller pair 20 through the registration roller pair 17, an image transfer portion (e.g., a transfer nip) formed between the transfer roller 14 and the photoconductor 2, and the fixing device 12. The sheet P is conveyed through the conveyance path 101. When the image forming apparatus 1000 performs duplex printing, the sheet P that has passed the fixing device 12 is conveyed through the duplex conveyance path 102 to the image transfer portion again.

Referring to FIG. 1, a description is provided of an image forming operation of the image forming apparatus 1000 according to the embodiment.

When the image forming operation starts, a driver disposed in the apparatus body 100 drives and rotates the photoconductor 2. The charging roller 3 charges the surface of the photoconductor 2 uniformly at a predetermined polarity. The LED head array 6 exposes the charged surface of the photoconductor 2 according to image data sent from a reading device, a client computer, or the like, thus forming an electrostatic latent image on the surface of the photoconductor 2. The developing device 4 supplies toner to the electrostatic latent image formed on the photoconductor 2, visualizing the electrostatic latent image as a visible toner image.

When the image forming operation starts, the driver starts driving and rotating the feed roller 16 to feed a sheet P from the sheet tray 15. The registration roller pair 17 interrupts conveyance of the sheet P sent from the feed roller 16. Thereafter, at a predetermined time, the driver resumes driving and rotating the registration roller pair 17. The registration roller pair 17 conveys the sheet P to the image transfer portion at a time when the toner image formed on the photoconductor 2 reaches the image transfer portion.

When the sheet P reaches the image transfer portion, a predetermined voltage is applied to the transfer roller 14 to generate a transfer electric field. The transfer electric field transfers the toner image formed on the photoconductor 2 onto the sheet P. The cleaning blade 5 removes toner failed to be transferred onto the sheet P and therefore remaining on the photoconductor 2 therefrom. The removed toner is conveyed and collected into the waste toner container 9 of the toner cartridge 7.

The sheet P transferred with the toner image is conveyed to the fixing device 12. As the sheet P bearing the toner image is conveyed through the fixing nip 80 formed between the fixing roller 18 and the pressure roller 19, the fixing roller 18 and the pressure roller 19 fix the toner image on the sheet P under heat and pressure. The sheet P is ejected onto the outside of the apparatus body 100 by the output roller pair 20 and stocked on the output tray 21.

If the image forming apparatus 1000 receives a print job that instructs duplex printing, the sheet P that has passed the fixing device 12 is not ejected onto the outside of the apparatus body 100 and is switched back and conveyed to the duplex conveyance path 102. The sheet P is conveyed through the duplex conveyance path 102 and is conveyed into the conveyance path 101 at a position in front of the registration roller pair 17. The registration roller pair 17 conveys the sheet P to the image transfer portion again. At the image transfer portion, the transfer roller 14 transfers a toner image onto a back side of the sheet P. The fixing device 12 fixes the toner image on the back side of the sheet P. Thereafter, the output roller pair 20 ejects the sheet P onto the outside of the apparatus body 100.

Figure 2:
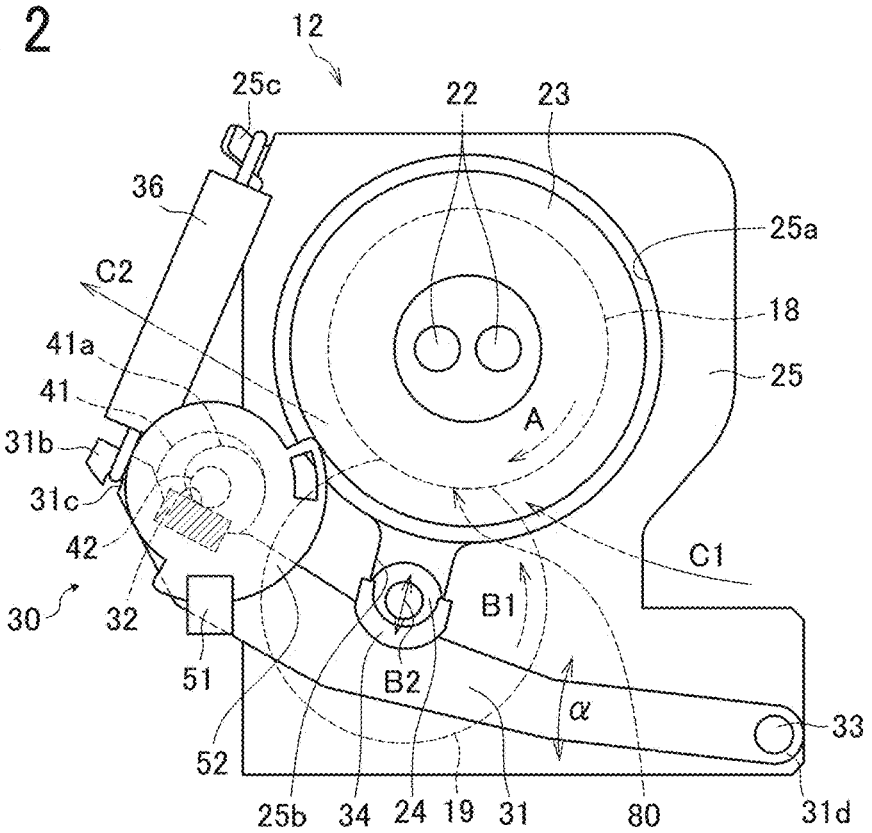
FIG. 2 is a schematic cross-sectional view of a fixing device according to an embodiment of the present disclosure that is incorporated in the monochrome image forming apparatus depicted in FIG. 1.

FIG. 2 is a schematic cross-sectional view of the fixing device 12 according to the embodiment.

Referring to FIG. 2, a detailed description is provided of the construction of the fixing device 12 according to the embodiment of the present disclosure.

The fixing device 12 further includes a pair of supports 25 and bearings 23 and 24. The supports 25 rotatably support both lateral ends of each of the fixing roller 18 and the pressure roller 19 in an axial direction thereof via the bearings 23 and 24, respectively. As a driving force is transmitted from the driver disposed inside the apparatus body 100 to the fixing roller 18, the fixing roller 18 is driven and rotated in a rotation direction A. The pressure roller 19 is driven and rotated in a rotation direction B1 in accordance with rotation of the fixing roller 18. According to the embodiment, the fixing roller 18 serves as a driving roller and the pressure roller 19 serves as a driven roller. Alternatively, the pressure roller 19 may serve as a driving roller and the fixing roller 18 may serve as a driven roller.

In a state in which the fixing roller 18 is heated to a predetermined temperature with radiant heat generated by the heaters 22, as the sheet P enters the fixing nip 80 in a sheet conveyance direction C1, the fixing roller 18 and the pressure roller 19, that rotate, convey the sheet P while the fixing roller 18 and the pressure roller 19 sandwich the sheet P. The fixing roller 18 heated by the heaters 22 heats an unfixed toner image on the sheet P. Simultaneously, the fixing roller 18 and the pressure roller 19 press the sheet P, fixing the unfixed toner image on the sheet P. The sheet P bearing the fixed toner image is ejected from the fixing nip 80 in a sheet conveyance direction C2.

The supports 25 support the pressure roller 19 such that the pressure roller 19 comes into contact with and separates from the fixing roller 18 in a contact-separation direction B2. For example, the bearing 24 that supports the pressure roller 19 is fitted in a bearing guide 25*b* as a rectangular hole disposed in each of the supports 25. As the bearing guide 25*b* guides the bearing 24, the pressure roller 19 comes into contact with and separates from the fixing roller 18. Conversely, the bearing 23 that supports the fixing roller 18 is fitted in a bearing engagement 25*a* as a circular hole disposed in each of the supports 25. Thus, the fixing roller 18 is secured to the bearing engagement 25*a* via the bearing 23 such that a shaft of the fixing roller 18 does not move in a direction perpendicular to the axial direction of the fixing roller 18.

The fixing device 12 according to the embodiment further includes a pressure lever 31 and a pressure spring 36. The pressure lever 31 presses the pressure roller 19 against the fixing roller 18. The pressure spring 36 serves as a biasing member that biases the pressure lever 31 in a pressurization direction. The pressure spring 36 also serves as a resilient member. The single pressure lever 31 and the single pressure spring 36 are disposed at each lateral end of the pressure roller 19 in the axial direction thereof. The pressure lever 31 includes a supported end 31*d*, that is, one end, that is supported by a support shaft 33 mounted on a lower portion of the support 25 in FIG. 2. The pressure lever 31 pivots about the support shaft 33 in a pivot direction a. Each of the pressure springs 36 is anchored to or hooked on hooks 31*c* and 25*c* that are mounted on a biased end 31*b*, that is, another end, of the pressure lever 31 and an upper portion of the support 25, respectively, in FIG. 2. Accordingly, the pressure spring 36 constantly holds and pulls the biased end 31*b* of the pressure lever 31 upward in FIG. 2.

The pressure lever 31 presses the bearing 24 that supports the pressure roller 19 through a pad 34 fitted in the bearing guide 25*b* of the support 25, thus pressing the pressure roller 19 against the fixing roller 18.

The fixing device 12 according to the embodiment further includes a pressing device 30 serving as a contact and separation mechanism that brings the pressure roller 19 into contact with the fixing roller 18 and separates the pressure roller 19 from the fixing roller 18. The pressing device 30 includes the pressure lever 31, a cam follower 32, the support shaft 33, the pressure spring 36, and a cam 41.

The cams 41 are mounted on both lateral ends of a rotation shaft 42 in an axial direction thereof, respectively, that is rotatably supported by the pair of supports 25. As the rotation shaft 42 rotates, the pair of cams 41 rotates together with the rotation shaft 42. Each of the cams 41 includes a cam face 41*a* defining a distance from a center of rotation of the cam 41, which varies in a rotation direction of the cam 41. As the pressure spring 36 pulls the pressure lever 31, the pressure lever 31 holds the cam follower 32 mounted on the pressure lever 31 in a state in which the cam follower 32 contacts the cam face 41*a* of the cam 41. Accordingly, as the cam 41 rotates forward in one direction, the cam face 41*a* presses and moves the pressure lever 31 downward in FIG. 2, separating the pressure roller 19 from the fixing roller 18. As the cam 41 rotates backward, the cam face 41*a* allows the pressure lever 31 to move upward in FIG. 2 and return to an original position, bringing the pressure roller 19 into contact with the fixing roller 18. Operations of the cam 41 that brings the pressure roller 19 into contact with the fixing roller 18 and separates the pressure roller 19 from the fixing roller 18 are described below in detail.

The fixing device 12 according to the embodiment further includes an optical sensor 51 and a light shield 52 that serve as a rotation position detector that detects a rotation position (e.g., a rotation angle) of the cam 41. The optical sensor 51 is a transmission type optical sensor. The optical sensor 51 includes a light emitter that emits light and a light receiver that receives the light emitted by the light emitter. As the light shield 52 rotates together with the cam 41, the light shield 52 blocks the light emitted by the optical sensor 51 or allows the light to transmit, prohibiting the light receiver from receiving the light or causing the light receiver to receive the light. Hence, the light shield 52 serves as a detected member of which rotation position is detected by the optical sensor 51. The optical sensor 51 and the light shield 52 are mounted on one of the two cams 41.

Figure 3:
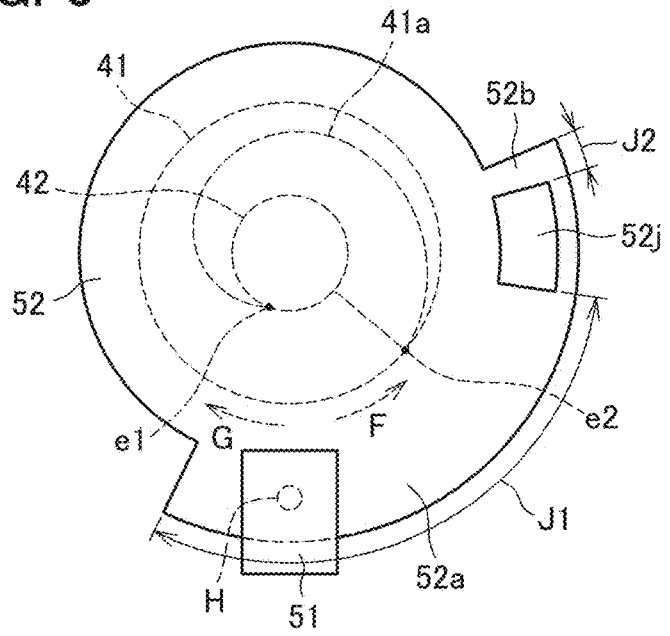
FIG. 3 is a diagram of a cam, a light shield, and an optical sensor incorporated in the fixing device depicted in FIG. 2.

FIG. 3 is a diagram of the cam 41, the light shield 52, and the optical sensor 51 of the fixing device 12 depicted in FIG. 2.

As illustrated in FIG. 3, the cam face 41*a* of the cam 41 gradually increases the distance from the center of rotation of the cam 41 clockwise in FIG. 3. The cam face 41*a* is disposed in a region (e.g., a span) greater than a semicircular region defining an angle of 180 degrees in the rotation direction of the cam 41. For example, according to the embodiment, the cam face 41*a* is disposed in a region (e.g., a span) that extends from a decreased distance point e1 (e.g., a smallest distance point) to an increased distance point e2 (e.g., a greatest distance point) and defines an angle of approximately 270 degrees. The distance from the center of rotation of the cam 41 to the cam face 41*a* is smallest at the decreased distance point e1 and is greatest at the increased distance point e2.

The light shield 52 includes an increased light shield portion 52*a* and a decreased light shield portion 52*b*. The increased light shield portion 52*a* serves as a detected region that has an increased length J1 in the rotation direction of the cam 41. The decreased light shield portion 52*b* serves as a detected region that has a decreased length J2 that is smaller than the increased length J1 of the increased light shield portion 52*a* in the rotation direction of the cam 41. As the light shield 52 mounted on the cam 41 rotates, the increased light shield portion 52*a* and the decreased light shield portion 52*b* pass over a light emitting portion H of the optical sensor 51, blocking the light emitted from the optical sensor 51. The light shield 52 includes a hole 52*j* (e.g., a light transmitting portion) through which the light emitted from the optical sensor 51 is transmitted. The hole 52*j* is interposed between the increased light shield portion 52*a* and the decreased light shield portion 52*b*.

Figure 4:
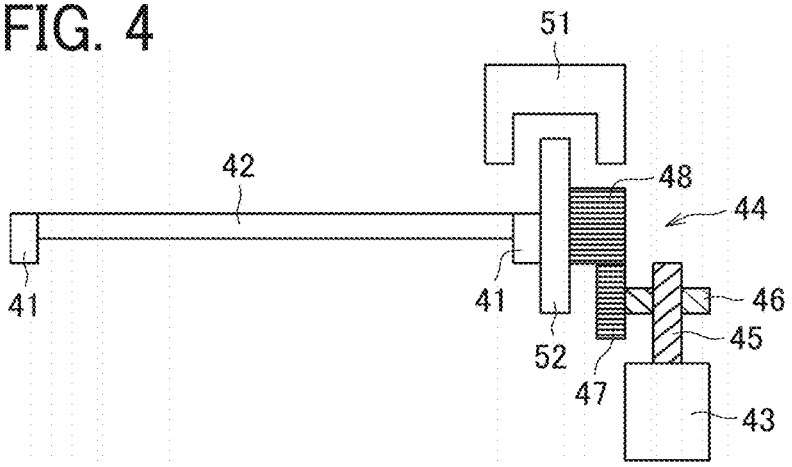
FIG. 4 is a schematic diagram of a driving system of a pressing device incorporated in the fixing device depicted in FIG. 2.

FIG. 4 is a schematic diagram of a driving system of the pressing device 30 according to the embodiment of the present disclosure.

As illustrated in FIG. 4, the driving system includes a motor 43 serving as a driver and a gear train 44 that transmits a driving force from the motor 43 to the cam 41 and the light shield 52. According to the embodiment, the motor 43 is a brushed direct current (DC) motor that is compact and is available at reduced costs. The gear train 44 includes a first worm gear 45, a second worm gear 46, a first spur gear 47, and a second spur gear 48. The first worm gear 45 is mounted on an output shaft of the motor 43. The second worm gear 46 meshes with the first worm gear 45. The first spur gear 47 is combined with the second worm gear 46. The second spur gear 48 meshes with the first spur gear 47 and is combined with the light shield 52. As the output shaft of the motor 43 rotates forward in one direction or backward in an opposite direction opposite to the one direction, each of the first worm gear 45 and the second worm gear 46 and each of the first spur gear 47 and the second spur gear 48 rotate. The second spur gear 48 and the light shield 52, that rotate together, rotate each of the cams 41 through the rotation shaft 42 in one direction (e.g., a rotation direction F depicted in FIG. 3) or an opposite direction (e.g., a rotation direction G opposite to the rotation direction F).

Figure 5:
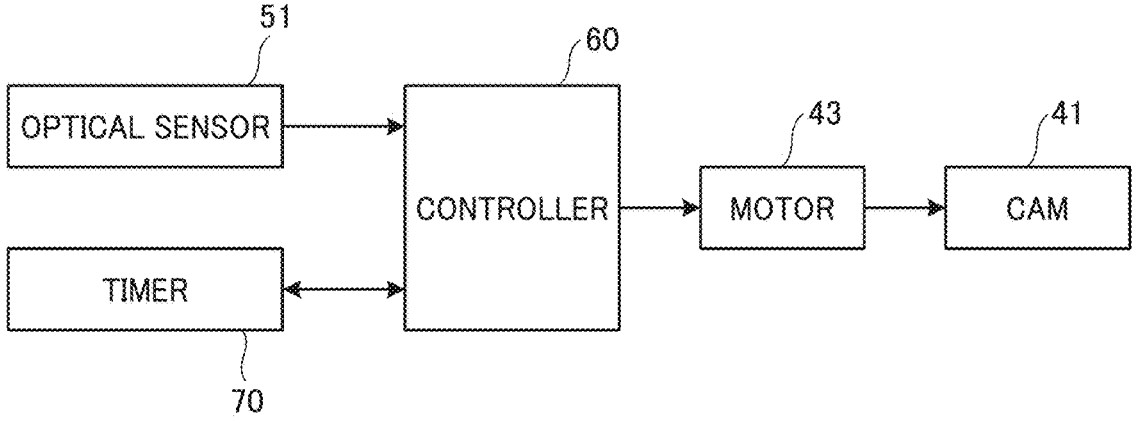
FIG. 5 is a block diagram of a control system of the pressing device incorporated in the fixing device depicted in FIG. 2.

FIG. 5 is a block diagram of a control system of the pressing device 30 serving as the contact and separation mechanism according to the embodiment.

As illustrated in FIG. 5, the control system includes a controller 60, the optical sensor 51, and a timer 70. The controller 60 controls rotation of the cam 41. The optical sensor 51 detects the rotation position of the cam 41. The timer 70 counts a rotation time of the cam 41.

For example, the controller 60 includes a central processing unit (CPU), a read only memory (ROM), and a random access memory (RAM) that are disposed inside the apparatus body 100. The controller 60 controls driving of the motor 43 based on a detection signal sent from the optical sensor 51 and a time counted by the timer 70 so as to control rotation of the cam 41. The controller 60 also controls a start time at which the timer 70 starts counting and a stop time at which the timer 70 stops counting based on the detection signal sent from the optical sensor 51.

In the fixing device 12 according to the embodiment, the pressure roller 19 comes into contact with and separates from the fixing roller 18 so as to change pressure applied at the fixing nip 80.

Referring to FIGS. 6A, 6B, 6C, 7A, 7B, and 7C, the following describes operations of the cam 41 to separate the pressure roller 19 from the fixing roller 18 and bring the pressure roller 19 into contact with the fixing roller 18, that is, a pressure releasing operation for releasing normal pressure and a pressing operation for retrieving the normal pressure.

Figure 6A:
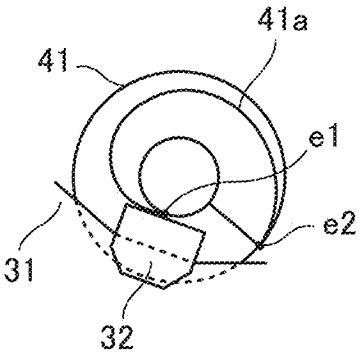
FIG. 6A is a diagram of the cam depicted in FIG. 3, illustrating a process of separating a pressure roller from a fixing roller incorporated in the fixing device depicted in FIG. 2.

FIG. 6A illustrates a state in which the cam follower 32 mounted on the pressure lever 31 contacts the cam face 41*a* of the cam 41 at the decreased distance point e1. The pressure lever 31 brings the pressure roller 19 depicted in FIG. 2 into contact with the fixing roller 18 and presses the pressure roller 19 against the fixing roller 18 with the normal pressure.

Figure 6B:
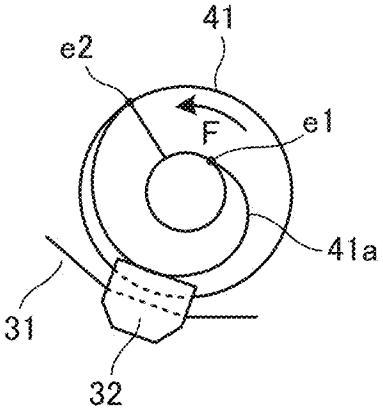
FIG. 6B is a diagram of the cam depicted in FIG. 6A, illustrating another process of separating the pressure roller from the fixing roller.

As the cam 41 rotates from a position depicted in FIG. 6A counterclockwise in FIG. 6B in the rotation direction F, the cam face 41*a* slides over the cam follower 32, changing a contact position on the cam face 41*a* that contacts the cam follower 32 from the decreased distance point e1 to the increased distance point e2 relatively. Accordingly, the cam face 41*a* presses and moves the cam follower 32 downward in FIG. 6B. The pressure lever 31 retracts from the bearing 24 supporting the pressure roller 19 and moves in a direction in which the pressure lever 31 separates the pressure roller 19 from the fixing roller 18.

Figure 6C:
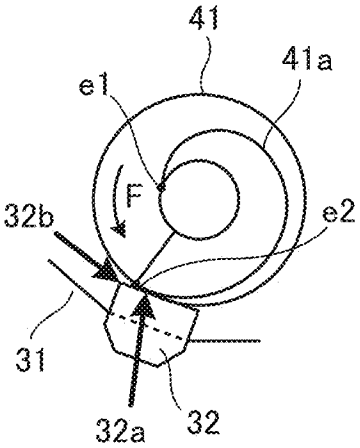
FIG. 6C is a diagram of the cam depicted in FIG. 6A, illustrating yet another process of separating the pressure roller from the fixing roller.

As illustrated in FIG. 6C, the contact position on the cam face 41*a* that contacts the cam follower 32 changes to the increased distance point e2. Accordingly, the pressure roller 19 separates from the fixing roller 18. Consequently, the pressure roller 19 presses against or is disposed opposite the fixing roller 18 at the fixing nip 80 with pressure smaller than the normal pressure in a depressurization state. Accordingly, the controller 60 interrupts rotation of the cam 41.

Figure 7A:
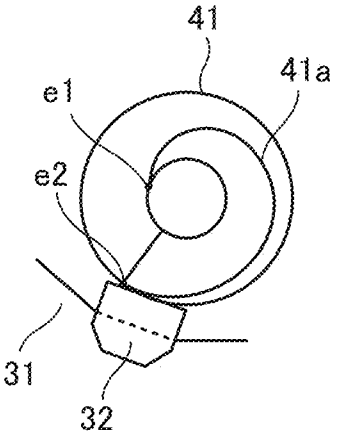
FIG. 7A is a diagram of the cam depicted in FIG. 3, illustrating a process of bringing the pressure roller into contact with the fixing roller.
Figure 7B:
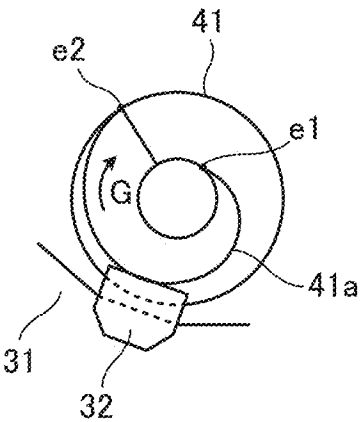
FIG. 7B is a diagram of the cam depicted in FIG. 7A, illustrating another process of bringing the pressure roller into contact with the fixing roller.

The motor 43 rotates the cam 41 in the depressurization state depicted in FIG. 7A clockwise as illustrated in FIG. 7B in the rotation direction G that is opposite to the rotation direction F depicted in FIG. 6B in which the cam 41 rotates to release pressure as described above. Hence, the cam face 41*a* slides over the cam follower 32, changing the contact position on the cam face 41*a* that contacts the cam follower 32 from the increased distance point e2 to the decreased distance point e1 relatively. Accordingly, a biasing force from the pressure spring 36 lifts the cam follower 32 upward in FIG. 7C. The pressure lever 31 presses the bearing 24 supporting the pressure roller 19. Consequently, the pressure roller 19 moves closer to the fixing roller 18.

Figure 7C:
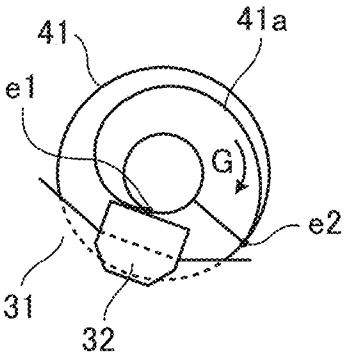
FIG. 7C is a diagram of the cam depicted in FIG. 7A, illustrating yet another process of bringing the pressure roller into contact with the fixing roller.

As illustrated in FIG. 7C, the contact position on the cam face 41*a* that contacts the cam follower 32 changes to the decreased distance point e1. Accordingly, the pressure roller 19 comes into contact with the fixing roller 18. The pressure roller 19 and the fixing roller 18 return to a pressurization state in which the pressure roller 19 and the fixing roller 18 retrieve the normal pressure (e.g., increased pressure) applied at the fixing nip 80. Accordingly, the controller 60 interrupts rotation of the cam 41.

As described above, in the fixing device 12 according to the embodiment, the cam 41 rotates in one direction (e.g., the rotation direction F) to separate the pressure roller 19 from the fixing roller 18. The cam 41 rotates in the opposite direction (e.g., the rotation direction G) to bring the pressure roller 19 into contact with the fixing roller 18. The identical cam face 41*a* is used to press and move the pressure lever 31 and return the pressure lever 31.

Figure 8:
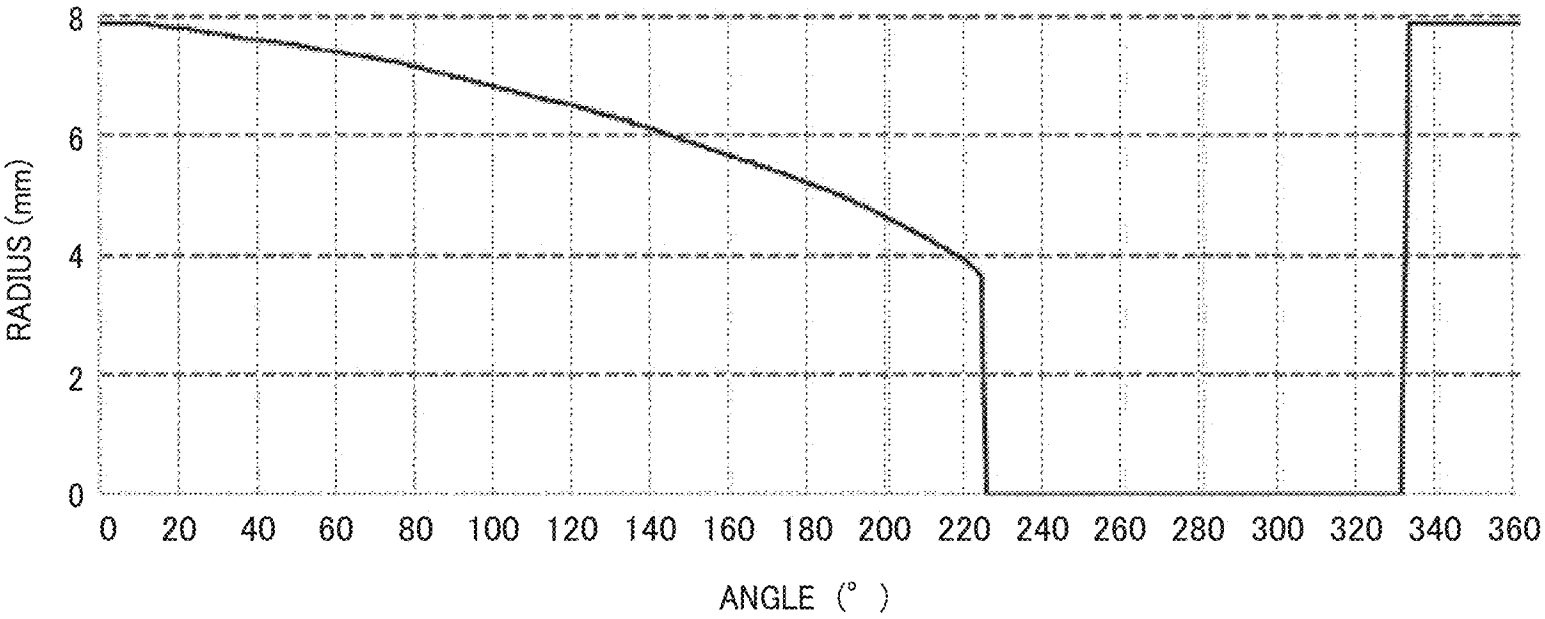
FIG. 8 is a cam diagram of the cam depicted in FIG. 3, illustrating a relation between a rotation angle of the cam and a radius of the cam.

FIG. 8 is a cam diagram of the cam 41, illustrating a relation between the rotation angle of the cam 41 and a radius of the cam 41.

In order to move the cam 41 smoothly, the cam face 41*a* defines a sine curve illustrated in FIG. 8. As a load imposed on the cam face 41*a* increases, a change amount of the cam face 41*a* decreases, so as to prevent sharp change in the load imposed on the cam face 41*a*, stabilize motion of the cam 41, decrease the load imposed on the motor 43, and prevent noise.

As the load imposed on the cam face 41*a* decreases, a curvature of the cam face 41*a* increases. As the load imposed on the cam face 41*a* increases, the curvature of the cam face 41*a* decreases. Hence, as illustrated in the cam diagram in FIG. 8, as the radius of the cam 41 increases, inclination of the sine curve decreases.

A description is provided of a construction of a comparative contact and separation mechanism.

The comparative contact and separation mechanism includes a cam that rotates to bring a contact-separation member into contact with a counterpart member and to separate the contact-separation member from the counterpart member.

The cam includes a cam face defining a distance from a center of rotation of the cam, that increases gradually in a rotation direction of the cam, throughout a region greater than a semicircle in the rotation direction of the cam. The cam rotates in one direction and an opposite direction opposite to the one direction.

An image forming apparatus and a fixing device that is installed with the comparative contact and separation mechanism and installed in the image forming apparatus are requested to save space and reduce costs.

In order to save space and reduce costs, elements of the image forming apparatus and the fixing device may be downsized or thinned. For example, a fixing device incorporating the comparative contact and separation mechanism includes a pressure lever that is platy and manufactured without complex machining, thus saving space. The fixing device may include the cam and an abutment that contacts the cam. The cam and the abutment are made of a resin material that is processed readily. The fixing device may be constructed of compact parts. Thus, the fixing device suppresses an amount of materials, reducing manufacturing costs.

However, the elements of the image forming apparatus and the fixing device, which are thinned or downsized, may suffer from decreased mechanical strength. For example, the fixing device includes a cam follower that receives pressure from the cam. As the cam follower is exerted with load repeatedly, the cam follower may suffer from deformation or breakage and the like over time.

To address the circumstances of the comparative contact and separation mechanism described above, the fixing device 12 according to the embodiment of the present disclosure includes the cam follower 32 which has a dimension and a shape that are designed to achieve strength and downsizing based on a contact portion of the cam follower 32, that contacts the cam 41, and a contact portion of the cam follower 32, that contacts the pressure lever 31. Accordingly, the fixing device 12 includes elements that are optimized in size and arrangement. Further, the fixing device 12 employs materials selected properly, saving space, reducing costs, and improving durability. The following describes a construction of the cam follower 32 of the fixing device 12 according to the embodiment of the present disclosure.

Figure 9:
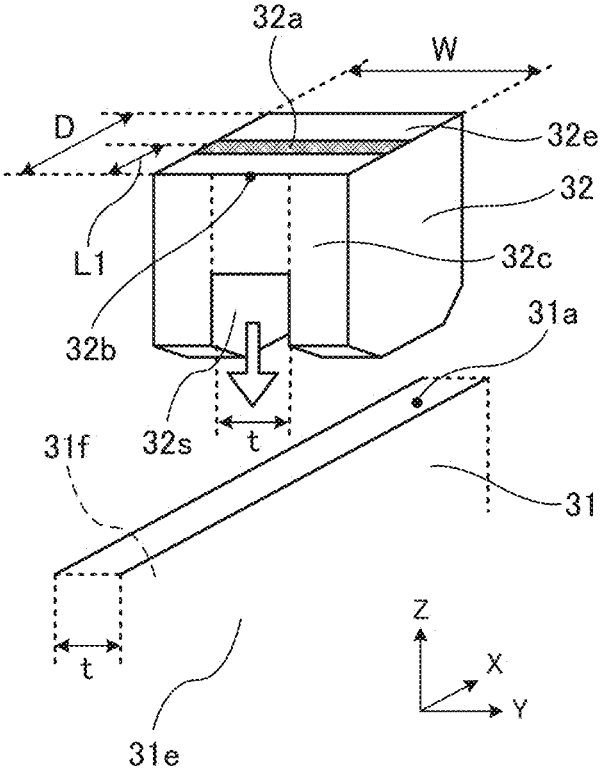
FIG. 9 is a perspective view of a cam follower and a pressure lever incorporated in the fixing device depicted in FIG. 2, illustrating the cam follower to be attached to the pressure lever.

As illustrated in FIG. 2, the fixing device 12 according to the embodiment includes a pair of rollers, the pressure lever 31, the cam 41, and the cam follower 32. For example, the pair of rollers includes the pressure roller 19 and the fixing roller 18 that are pressed against each other. The pressure roller 19 comes into contact with the fixing roller 18 and separates from the fixing roller 18. The pressure roller 19 and the fixing roller 18 sandwich and convey a recording medium. The pressure lever 31 includes one end, that is, the supported end 31*d*, that is supported by the support shaft 33. The pressure lever 31 further includes another end, that is, the biased end 31*b*, that engages the pressure spring 36 serving as the resilient member. The pressure lever 31 is platy and pivots to press one of the pair of rollers (e.g., the pressure roller 19) against another one of the pair of rollers (e.g., the fixing roller 18). The cam 41 moves the pressure lever 31 between a pressing position where the pressure roller 19 presses against the fixing roller 18 and a pressure release position where the pressure roller 19 releases pressure applied to the fixing roller 18. The cam follower 32 is mounted on the pressure lever 31 and disposed opposite the cam 41. The cam follower 32 transmits pressure from the cam 41 to the pressure lever 31. As illustrated in FIG. 9, the pressure lever 31 has a thickness t. The cam follower 32 has a contact face 32*e* that contacts the cam 41. The contact face 32*e* has a length W in a thickness direction (e.g., Y-direction) of the pressure lever 31. The contact face 32*e* has a length L1 in an orthogonal direction (e.g., X-direction) perpendicular to the thickness direction of the pressure lever 31. The length L1 is defined from a contact position 32*a* where the cam follower 32 contacts the cam 41 to a side face 32*c* of the cam follower 32. The thickness t, the length W, and the length L1 satisfy a formula (1) below.

$$L1 \geq 0.6 \times (W-t)/2+0.2 \quad (1)$$

Figure 10:
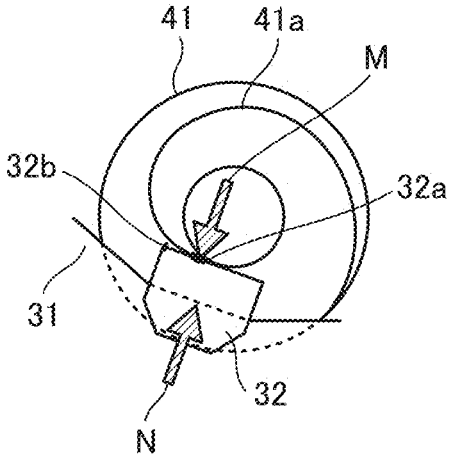
FIG. 10 is a diagram of the cam follower depicted in FIG. 9 that contacts the cam.
Figure 11:
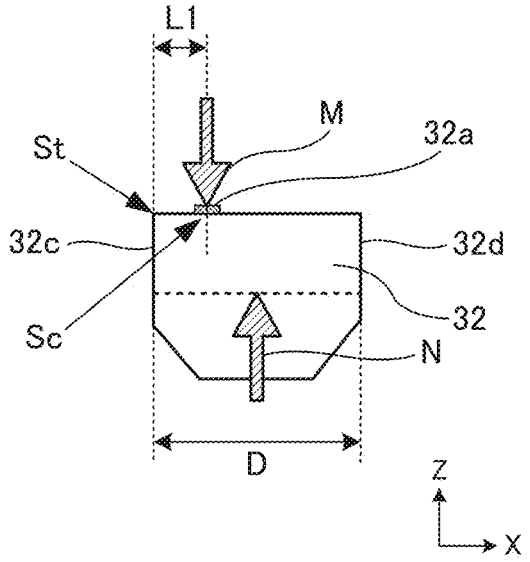
FIG. 11 is a diagram of the cam follower depicted in FIG. 10, illustrating load and stress applied to the cam follower.
Figure 12:
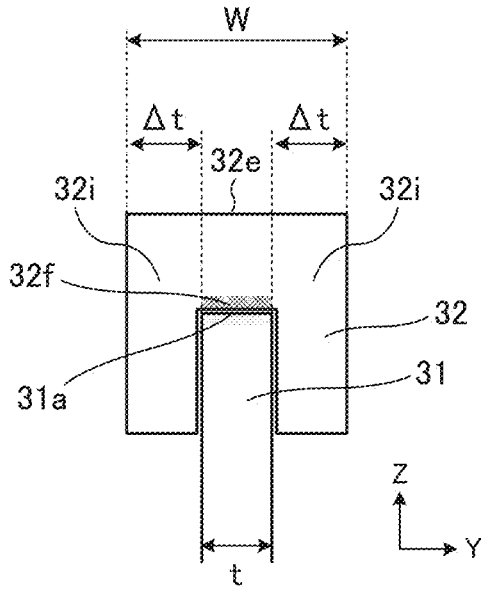
FIG. 12 is a diagram of the cam follower depicted in FIG. 9, illustrating dimensions of the cam follower in a thickness direction of the pressure lever.

Referring to FIGS. 10, 11, and 12, a description is provided of the thickness t, the length W, and the length L1 of the formula (1).

FIG. 10 is a diagram of the cam follower 32 that contacts the cam 41. FIG. 11 is a diagram of the cam follower 32, illustrating load and stress applied to the cam follower 32.

As illustrated in FIG. 10, the cam follower 32 receives a load M applied downward in FIG. 10 at a contact position 32*b* on the cam follower 32 where the cam follower 32 contacts the cam 41. The cam follower 32 receives a load N applied upward in FIG. 10 at a contact face of the cam follower 32, that contacts the pressure lever 31.

FIG. 10 illustrates the cam follower 32 installed in the fixing device 12 depicted in FIG. 2. Hence, the cam follower 32 is inclined such that the contact face contacting the pressure lever 31 is inclined. However, the following describes the construction of the cam follower 32 with reference to drawings illustrating the cam follower 32 that is disposed horizontally.

As illustrated in FIG. 11, the cam follower 32 has an entire length D in the orthogonal direction (e.g., X-direction) perpendicular to the thickness direction of the pressure lever 31.

The cam follower 32 has the length L1 in the orthogonal direction (e.g., X-direction) perpendicular to the thickness direction of the pressure lever 31. The length L1 is defined from the contact position 32*a* on the cam follower 32 where the cam follower 32 contacts the cam 41 to one side face, that is, the side face 32*c* (e.g., a left side face in FIG. 11), of the cam follower 32.

If the cam follower 32 contacts the cam 41 in a contact region that has a width in the orthogonal direction (e.g., X-direction) perpendicular to the thickness direction of the pressure lever 31, the contact position 32*a* defines a center of the contact region where the cam follower 32 contacts the cam 41 in the orthogonal direction (e.g., X-direction).

FIG. 12 is a diagram of the cam follower 32, illustrating dimensions of the cam follower 32 in the thickness direction of the pressure lever 31.

As illustrated in FIG. 12, the cam follower 32 has the length W that defines an entire length of the contact face 32*e* (e.g., a contact region) of the cam follower 32, that contacts the cam 41, in the thickness direction (e.g., Y-direction) of the pressure lever 31. The contact face 32*e* has an area that varies depending on a shape of an opposed face of the cam follower 32, which is disposed opposite the cam 41. Hence, the length W may be different from an entire length of the cam follower 32 in Y-direction.

The pressure lever 31 has the thickness t. The thickness t of the pressure lever 31 defines a thickness of a sheet metal that is platy and constructs the pressure lever 31.

The cam follower 32 has a length Δt, that is, a variable defined by (W−t)/2 in the formula (1). The contact face 32*e* contacts the cam 41 and has the length W. The cam follower 32 includes a contact portion 32*f* that contacts the pressure lever 31 and outboard portions 32*i* that are disposed outboard from the contact portion 32*f* in the thickness direction (e.g., Y-direction) of the pressure lever 31. Each of the outboard portions 32*i* has the length Δt.

FIG. 11 illustrates a load stress Sc generated at the contact position 32*a* on the cam follower 32 where the cam follower 32 contacts the cam 41. The load stress Sc is calculated by simulation.

FIG. 11 illustrates a load stress St generated at an upper end corner of the side face 32*c* (e.g., the left side face in FIG. 11) of the cam follower 32, that is, at a portion that is susceptible to a crack as an origin of breakage of the cam follower 32. The load stress St is calculated by simulation.

Figure 13A:
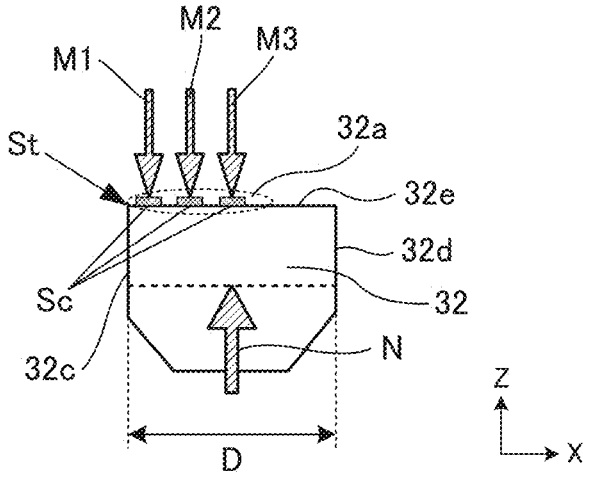
FIG. 13A is a diagram of the cam follower depicted in FIG. 11, illustrating load reception positions where the cam follower receives loads, respectively.
Figure 13B:
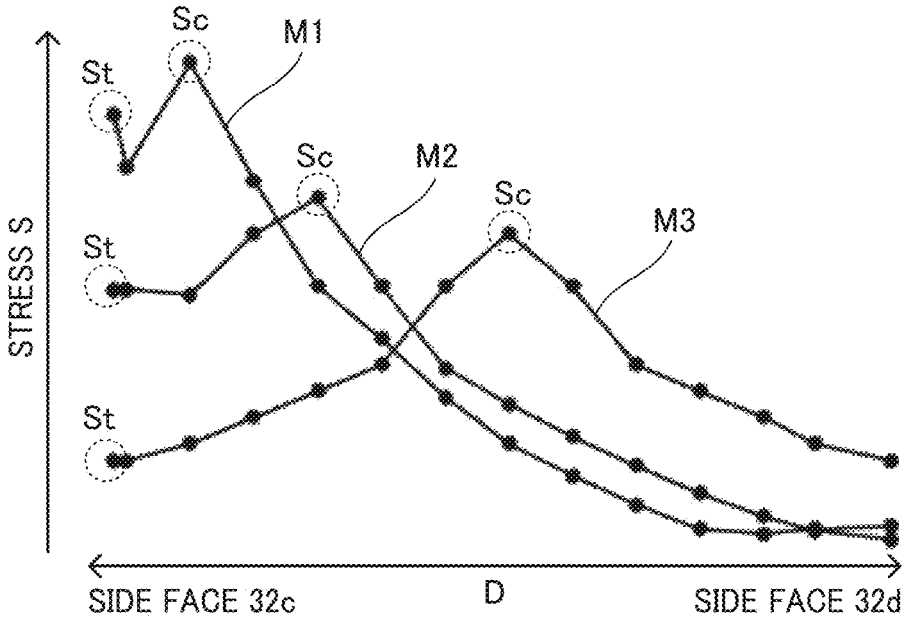
FIG. 13B is a graph illustrating stress distributions on the load reception positions depicted in FIG. 13A, respectively.

FIGS. 13A and 13B illustrate a diagram and a graph relating to the simulations, respectively.

FIG. 13A is a diagram illustrating load reception positions where the cam follower 32 receives loads M1, M2, and M3, respectively, with the cam follower 32 performed with the simulations. FIG. 13B is a graph illustrating stress distributions on the load reception positions where the cam follower 32 receives the loads M1, M2, and M3, respectively.

As illustrated in FIG. 13A, if the contact position 32*a* on the cam follower 32 where the cam follower 32 contacts the cam 41 is situated at a center of the contact face 32*e* having the entire length D of the cam follower 32 in X-direction, the load M3 is imposed on the cam follower 32. If the contact position 32*a* is situated at one end of the contact face 32*e*, that is in proximity to the side face 32*c* (e.g., the left side face in FIG. 13A), the load M1 is imposed on the cam follower 32. If the contact position 32*a* is situated at an intermediate position on the contact face 32*e* between the center and the one end of the contact face 32*e*, the load M2 is imposed on the cam follower 32. The loads M1, M2, and M3 are equivalent. FIG. 13B illustrates the stress distributions of the loads M1, M2, and M3, respectively, in the entire length D of the cam follower 32 in X-direction.

As illustrated in FIG. 13B, in each of the stress distributions of the loads M1, M2, and M3, the load stress Sc is greatest at the contact position 32*a* on the cam follower 32 where the cam follower 32 contacts the cam 41. Although the loads M1, M2, and M3 are equivalent, stress S increases as the contact position 32*a* is closer to the one end of the contact face 32*e* in X-direction. For example, the load stress Sc is greatest with the load M1.

The load stress St generates at a leftmost position in the graph in FIG. 13B, that is, at the upper end corner of the side face 32*c* (e.g., the left side face of the cam follower 32 in FIG. 13A). Like the load stress Sc, stress S increases as the contact position 32*a* is closer to the one end of the contact face 32*e* in X-direction. For example, the load stress St is greatest with the load M1.

Figure 14:
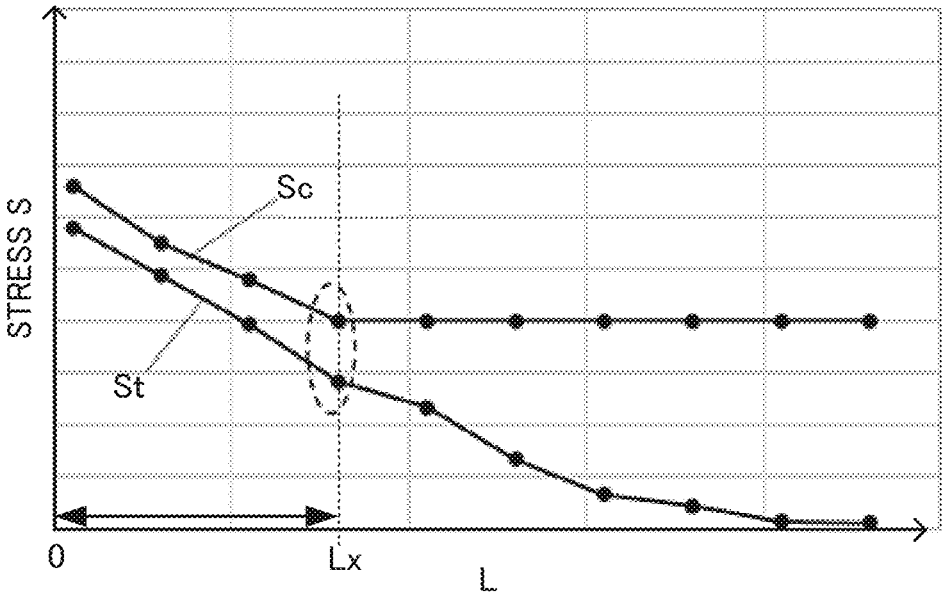
FIG. 14 is a graph illustrating change in stress according to change in the load reception positions on the cam follower depicted in FIG. 13A.

FIG. 14 is a graph illustrating change in the stress S as the contact position 32*a* on the cam follower 32 where the cam follower 32 contacts the cam 41 (e.g., a position applied with the load M) changes from a left end to a right end of the contact face 32*e* in X-direction in FIG. 13A. The load M is constant.

FIG. 14 illustrates a length L on a horizontal axis, which is defined from the contact position 32*a* on the cam follower 32 where the cam follower 32 contacts the cam 41 to the left end of the contact face 32*e* (e.g., the side face 32*c*) in FIG. 13A. When the contact position 32*a* is situated at the left end of the contact face 32*e* (e.g., the side face 32*c*) in FIG. 13A, the length L is zero. As the contact position 32*a* moves to the right end of the contact face 32*e* (e.g., a side face 32*d*) in FIG. 13A, the length L increases.

As illustrated in the graph in FIG. 14, each of the load stresses Sc and St is greatest at a position in proximity to a position where the length L is zero. The load stress Sc approximates the load stress St. The load stress Sc decreases as the length L increases. The load stress Sc is constant with a value indicated with a broken circle at positions disposed rightward from a position Lx in FIG. 14. The load stress St also decreases as the length L increases. The load stress St is smaller than a value indicated with the broken circle also at the positions disposed rightward from the position Lx in FIG. 14. For example, at the positions disposed rightward from the position Lx in FIG. 14, deviation of the load stress St from the load stress Sc increases.

Generation of a crack of the cam follower 32 was examined. In a span defined from a position where the length L was zero to the position Lx, generation of an early crack was observed. The early crack indicates that a region defined from the contact position 32*a* on the cam follower 32 where the cam follower 32 contacts the cam 41 to the upper end corner of the side face 32*c* in FIG. 13A retains an increased stress. Hence, the cam follower 32 is susceptible to progress of creep fatigue.

To address this circumstance, the contact position 32*a* where the cam follower 32 contacts the cam 41 is disposed at a position where the length L is greater than a span where the load stress Sc approximates the load stress St, that is, the span defined from the position where the length L is zero to the position Lx. Thus, the cam follower 32 is immune from a crack and creep fracture.

The length Δt depicted in FIG. 12 contributes to a condition (e.g., a threshold) that determines whether or not the load stress St deviates from the load stress Sc depending on the length L. The length Δt is the variable defined by (W−t)/2 in the formula (1).

Figure 15:
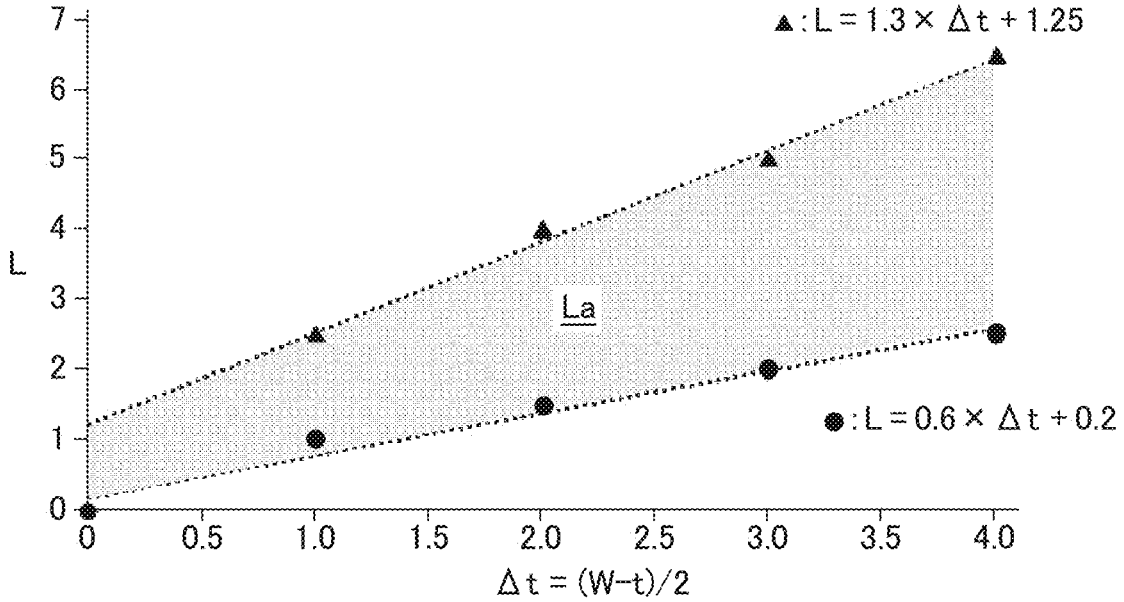
FIG. 15 is a graph illustrating results of simulation for analyzing stress for combination of a length Δt and a length L of the cam follower depicted in FIG. 12.

FIG. 15 illustrates results of simulation for analyzing stress for combination of the length Δt and the length L.

The graph in FIG. 15 illustrates a horizontal axis representing the length Δt defined by (W−t)/2 and a vertical axis representing the length L. The graph illustrates results plotted with circular spots that indicate values of the length L (e.g., the position Lx in FIG. 14) where the load stress St starts deviating from the load stress Sc. The circular spots create a line indicated by an approximation formula, that is, a formula (2) below.

$$L=0.6\times\Delta t+0.2 \quad (2)$$

In designing the cam follower 32, if the length Δt is determined based on the thickness t of the pressure lever 31 constructed of the sheet metal that is platy, the contact position 32*a* where the cam follower 32 contacts the cam 41 is set at a position defining a length from one end face (e.g., one side face in the orthogonal direction perpendicular to the thickness direction of the pressure lever 31) of the cam follower 32. The length is greater than the length L calculated according to the formula (2). Thus, the cam follower 32 is immune from a crack.

For example, in the fixing device 12 according to the embodiment, the length L1 is defined from the contact position 32*a* where the cam follower 32 contacts the cam 41 to one side face (e.g., the side face 32*c*) of the cam follower 32. The length L1 is defined by the formula (1) described above, that is, L1≥0.6×(W−t)/2+0.2. Thus, the cam follower 32 is immune from a crack.

As defined by the formula (2), the length Δt as the variable determines deviation of the load stress St from the load stress Sc. Hence, a proper shape of the cam follower 32 is determined in view of a relation to the contact position 32*a* where the cam follower 32 contacts the cam 41. Based on the determined proper shape of the cam follower 32, a material of the cam follower 32 and an amount of stress received by the cam follower 32 from the cam 41 are considered. Accordingly, a material that achieves an enhanced strength of the cam follower 32 unnecessarily is not selected and used, preventing increase in manufacturing costs.

As illustrated in the graph in FIG. 14, the load stress St decreases as the length L increases. The load stress St is approximately zero at a position in proximity to a position where the length L is maximum. If the load stress St is approximately zero, the cam follower 32 is barely susceptible to a crack. Hence, the length L is not designed to increase further.

FIG. 15 illustrates the results of simulation for analyzing stress for combination of the length Δt and the length L with the load stress St of zero.

The graph in FIG. 15 illustrates the horizontal axis representing the length Δt defined by (W−t)/2 and the vertical axis representing the length L. The graph illustrates results plotted with triangular spots that indicate values of the length L with the load stress St of zero. The triangular spots create a line indicated by an approximation formula, that is, a formula (3) below.

$$L=1.3\times\Delta t+1.25 \quad (3)$$

FIG. 15 illustrates an area La that is enclosed by the line defined by the formula (2) and the line defined by the formula (3) and indicates a proper range of the length Δt.

In designing the cam follower 32, if the length Δt is determined based on the thickness t of the pressure lever 31 constructed of the sheet metal that is platy, the contact position 32*a* where the cam follower 32 contacts the cam 41 is set at a position defining a length from one end face (e.g., one side face in the orthogonal direction perpendicular to the thickness direction of the pressure lever 31) of the cam follower 32 The length is smaller than the length L calculated according to the formula (3) and is greater than the length L calculated according to the formula (2), thus preventing a crack of the cam follower 32 and downsizing the cam follower 32.

For example, in the fixing device 12 according to the embodiment, the length L1 is defined from the contact position 32*a* where the cam follower 32 contacts the cam 41 to one side face (e.g., the side face 32*c*) of the cam follower 32. Additionally, the thickness t, the length W, and the length L1 satisfy a formula (4) below.

$$L1<1.3\times(W-t)/2+1.25 \quad (4)$$

Thus, the cam follower 32 is immune from a crack and is downsized.

FIG. 15 illustrates the area La that is enclosed by the line defined by the formula (2) and the line defined by the formula (3) and indicates the proper range of the length Δt.

Like the formula (2), the formula (3) considers the length Δt as the variable. Hence, the proper shape of the cam follower 32 is determined in view of the relation to the contact position 32*a* where the cam follower 32 contacts the cam 41. Based on the determined proper shape of the cam follower 32, a material of the cam follower 32 and an amount of stress received by the cam follower 32 from the cam 41 are considered. Accordingly, a material that achieves an enhanced strength of the cam follower 32 unnecessarily is not selected and used, preventing increase in manufacturing costs.

In order to narrow a proper range of the length L further, strength of the material of the cam follower 32 and the amount of stress received by the cam follower 32 from the cam 41 are considered.

As described above, consideration of a relation between the length L and the length Δt prevents the cam follower 32 from being upsized unnecessarily. The fixing device 12 employs a pressurization-depressurization mechanism (e.g., the pressing device 30) having a simple construction with proper materials that are selected to attain mechanical strength at reduced costs. The fixing device 12 improves sizes and arrangement of parts. As a result, the fixing device 12 saves space and reduces manufacturing costs. Additionally, the fixing device 12 prevents breakage of the cam follower 32, improving durability of the fixing device 12.

A description is provided of examples of an external shape of the cam follower 32.

Figure 16:
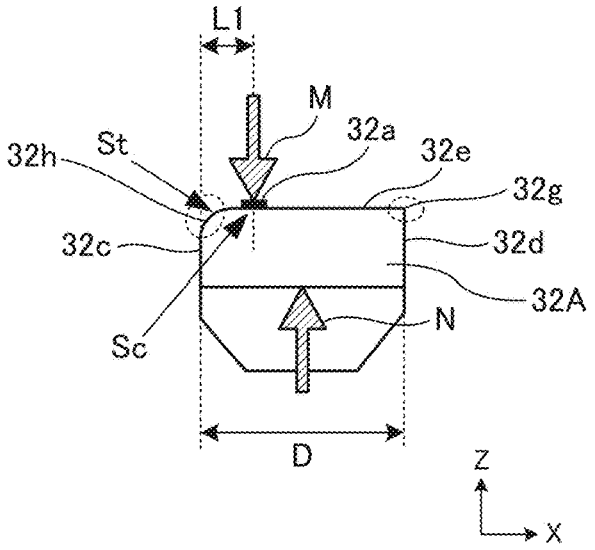
FIG. 16 is a diagram of a cam follower as a variation of the cam follower depicted in FIG. 9.

Referring to FIG. 16, a description is provided of a construction of a cam follower 32A according to a first embodiment of the present disclosure.

FIG. 16 is a side view of the cam follower 32A, illustrating the external shape of the cam follower 32A.

The cam follower 32A includes corners 32*g* and 32*h*. The corner 32*g* is defined by the contact face 32*e*, which is disposed opposite the cam 41, and the side face 32*d* (e.g., a right outer face in FIG. 16). The corner 32*h* is defined by the contact face 32*e* and the side face 32*c* (e.g., a left outer face in FIG. 16). The side faces 32*c* and 32*d* are parallel to the thickness direction of the pressure lever 31. At least one of the corners 32*g* and 32*h* is preferably round. The corner 32*h* disposed at an upper end of the side face 32*c* (e.g., a left end face in FIG. 16) is preferably round. The corner 32*h* is susceptible to a crack as an origin of breakage of the cam follower 32.

Figure 17:
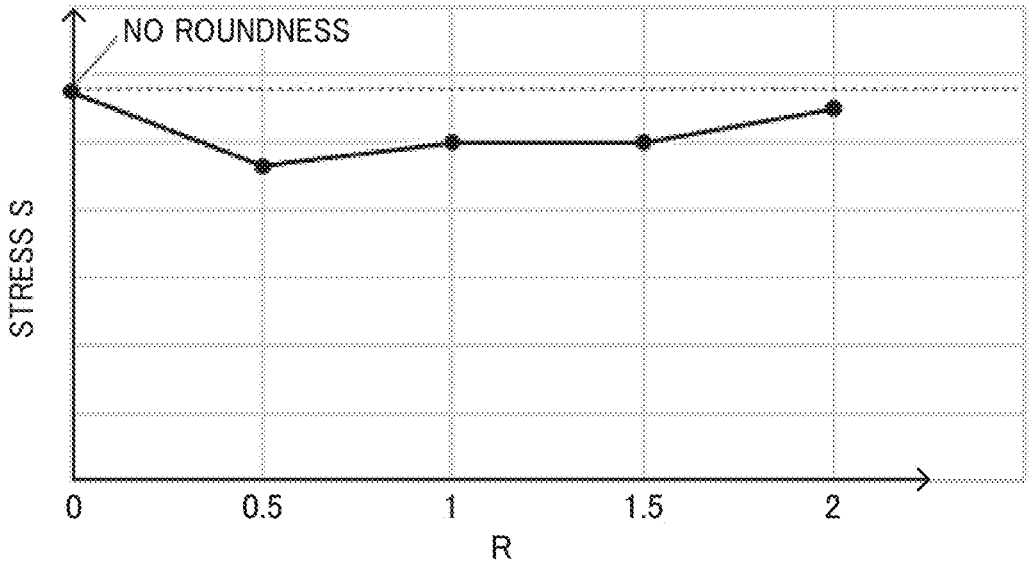
FIG. 17 is a graph illustrating results of simulation for analyzing stress applied on a round corner of the cam follower depicted in FIG. 16.

FIG. 17 is a graph illustrating results of simulation for analyzing stress on change in the load stress St as a size of roundness of the corner 32*h* depicted in FIG. 16 changes.

The load M imposed on the cam follower 32A from the cam 41 is constant in amount. The position imposed with the load M (e.g., the contact position 32*a* where the cam follower 32A contacts the cam 41) is constant.

As illustrated in FIG. 17, a stress S that generates at the corner 32*h* having a roundness R in a range of from R0.5 to R2.0 is smaller than a stress S that generates at a corner having no roundness. As described above, the corner 32*h* that is round decreases the load stress St imposed on the corner 32*h* that is subject to a crack.

Referring to FIGS. 9 and 12, a description is provided of a construction of the cam follower 32 according to a second embodiment of the present disclosure.

FIG. 9 is a perspective view of the cam follower 32 to be attached to the pressure lever 31. FIG. 12 is a cross-sectional view of the cam follower 32 depicted in FIG. 9 in the thickness direction of the pressure lever 31.

As illustrated in FIGS. 9 and 12, the cam follower 32 is substantially lateral U-shaped in cross section. The pressure lever 31 includes a pressed face 31*a* and side faces 31*e* and 31*f*. The pressed face 31*a* receives pressure from the cam 41. The side faces 31*e* and 31*f* are disposed opposite each other in the thickness direction of the pressure lever 31. The cam follower 32 preferably engages the pressure lever 31 such that the cam follower 32 covers at least a part of the pressed face 31*a*, the side face 31*e*, and the side face 31*f*. The cam follower 32 that is lateral U-shaped in cross section includes a recess 32*s* including a bottom face including the contact portion 32*f*. The contact portion 32*f* preferably has a length that attains a decreased difference from the thickness t of the pressure lever 31.

Figure 18A:
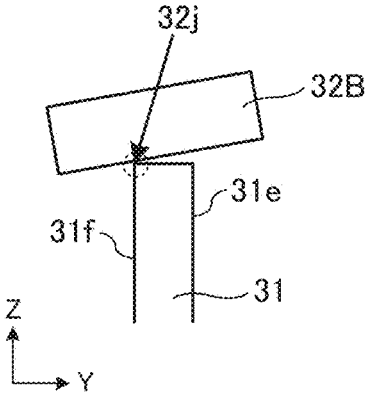
FIG. 18A is a diagram of a cam follower as another variation of the cam follower depicted in FIG. 9, that contacts the pressure lever unstably.
Figure 18B:
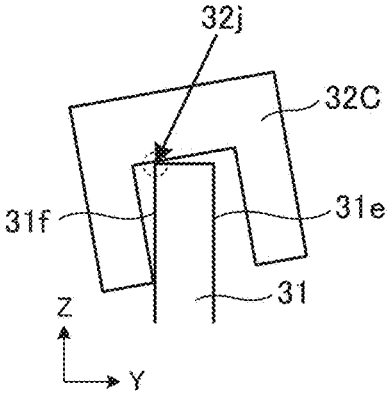
FIG. 18B is a diagram of a cam follower as yet another variation of the cam follower depicted in FIG. 9, that contacts the pressure lever unstably.

FIGS. 18A and 18B are diagrams of cam followers 32B and 32C, respectively, that contact the pressure lever 31 unstably.

As illustrated in FIG. 18A, the cam follower 32B does not cover the side faces 31*e* and 31*f* that are disposed opposite each other in the thickness direction of the pressure lever 31. As illustrated in FIG. 18B, the cam follower 32C covers the side faces 31*e* and 31*f* with increased clearances between the cam follower 32C and the side faces 31*e* and 31*f*, respectively. Hence, the cam followers 32B and 32C may contact the pressure lever 31 unstably. The cam followers 32B and 32C contact the pressure lever 31 partially. Accordingly, a local load is imposed on a contact portion 32*j* of each of the cam followers 32B and 32C, that contacts the pressure lever 31. Consequently, each of the cam followers 32B and 32C may suffer from breakage that originates in the contact portion 32*j*.

As illustrated in FIGS. 9 and 12, since the cam follower 32 is lateral U-shaped in cross section, the cam follower 32 engages the pressure lever 31 without backlash. The cam follower 32 is attached to the pressure lever 31 stably, preventing abnormal stress and load from being imposed on the cam follower 32. Thus, the cam follower 32 is immune from failure such as early breakage.

While the fixing device 12 is used, the cam follower 32 is immune from failure. Additionally, the cam follower 32 is immune from failure such as dropping of parts while the parts are assembled.

Referring to FIGS. 19A, 19B, 19C, 19D, and 20, a description is provided of a construction of each of cam followers 32D, 32E, 32F, and 32G according to a third embodiment of the present disclosure.

Figure 19A:
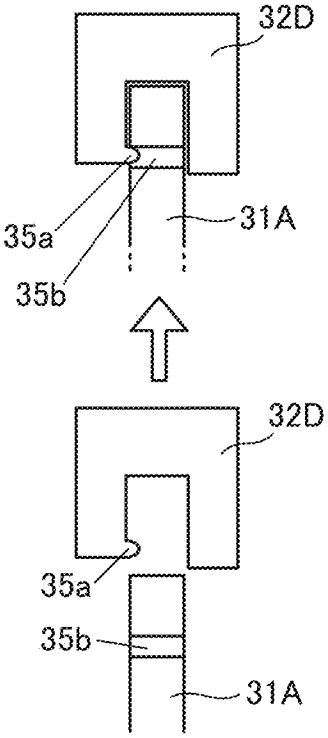
FIG. 19A is a diagram of a cam follower as yet another variation of the cam follower depicted in FIG. 9, illustrating an engagement of the cam follower that engages a pressure lever as a variation of the pressure lever depicted in FIG. 9.
Figure 19B:
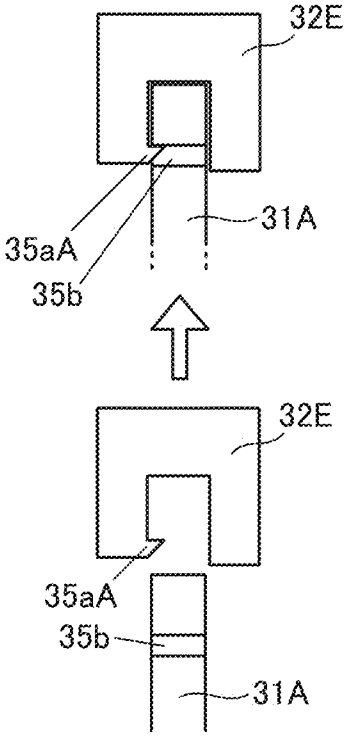
FIG. 19B is a diagram of a cam follower as yet another variation of the cam follower depicted in FIG. 9, illustrating an engagement of the cam follower that engages the pressure lever depicted in FIG. 19A.
Figure 19C:
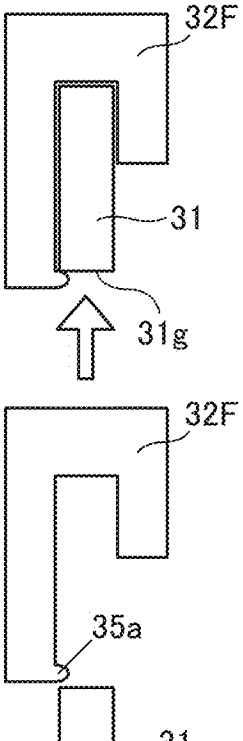
FIG. 19C is a diagram of a cam follower as yet another variation of the cam follower depicted in FIG. 9, illustrating an engagement of the cam follower that engages the pressure lever depicted in FIG. 9.
Figure 19D:
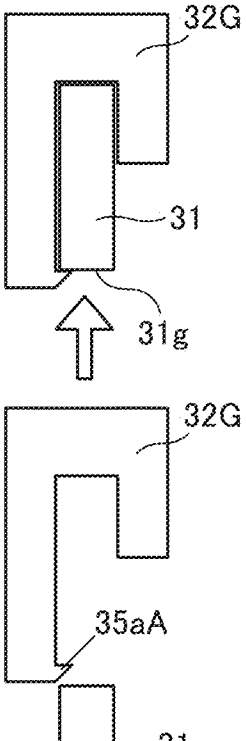
FIG. 19D is a diagram of a cam follower as yet another variation of the cam follower depicted in FIG. 9, illustrating an engagement of the cam follower that engages the pressure lever depicted in FIG. 9.
Figure 20:
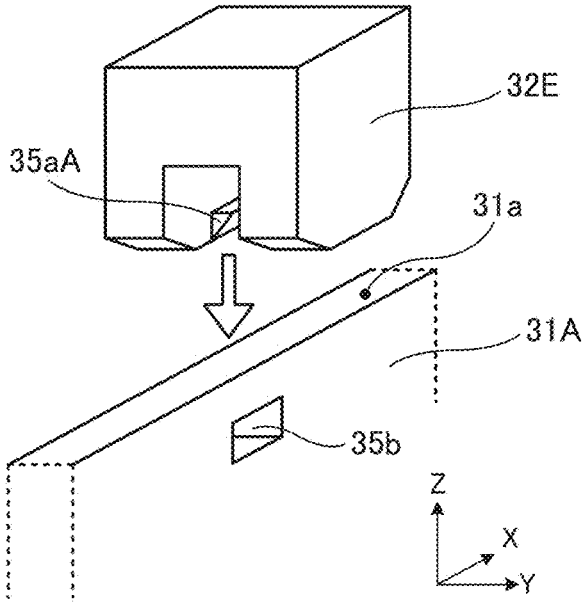
FIG. 20 is a perspective view of the cam follower depicted in FIG. 19B to be attached to the pressure lever depicted in FIG. 19B.

FIGS. 19A, 19B, 19C, 19D, and 20 are diagrams of engagements that engage the pressure lever 31 or a pressure lever 31A with the cam follower 32D, 32E, 32F, or 32G. FIGS. 19A, 19B, 19C, and 19D are cross-sectional views of the cam followers 32D, 32E, 32F, and 32G and the pressure levers 31A and 31 in the thickness direction thereof, respectively. FIG. 20 is a perspective view of the cam follower 32E and the pressure lever 31A depicted in FIG. 19B.

Each of the cam followers 32D, 32E, 32F, and 32G preferably includes the engagement that engages the engagement of the pressure lever 31 or 31A. For example, the engagements serve as a dropping preventing mechanism that prevents each of the cam followers 32D, 32E, 32F, and 32G from dropping.

FIGS. 19A, 19B, 19C, and 19D illustrate the cam followers 32D, 32E, 32F, and 32G that engage the pressure lever 31 or 31A in upper sections, respectively, and the cam followers 32D, 32E, 32F, and 32G that do not engage the pressure lever 31 or 31A yet in lower sections, respectively.

As illustrated in FIGS. 19A and 19B, the pressure lever 31A includes an engaging recess 35*b* serving as the engagement. As illustrated in FIG. 19A, the cam follower 32D includes an engaging projection 35*a* serving as the engagement that engages the engaging recess 35*b*. As illustrated in FIG. 19B, the cam follower 32E includes an engaging projection 35*a*A serving as the engagement that engages the engaging recess 35*b*.

As illustrated in FIG. 19C, the engaging projection 35*a* of the cam follower 32F engages a bottom 31*g*, serving as the engagement, of the pressure lever 31. As illustrated in FIG. 19D, the engaging projection 35*a*A of the cam follower 32G engages the bottom 31*g* of the pressure lever 31.

The engaging recess 35*b* of the pressure lever 31A has a shape that is not limited as long as the engaging recess 35*b* engages the engaging projection 35*a* of the cam follower 32D or the engaging projection 35*a*A of the cam follower 32E. For example, the engaging recess 35*b* may be a slot that penetrates through the pressure lever 31A in the thickness direction thereof or a groove.

The engaging projection 35*a* of the cam followers 32D and 32F and the engaging projection 35*a*A of the cam followers 32E and 32G have shapes that are not limited. For example, as illustrated in FIGS. 19A and 19C, the engaging projection 35*a* may be a bulge. As illustrated in FIGS. 19B and 19D, the engaging projection 35*a*A may be a claw that is triangular in cross section.

Even if the engaging recess 35*b* and the engaging projections 35*a* and 35*a*A have any of the shapes described above, the engaging recess 35*b* and the engaging projections 35*a* and 35*a*A preferably do not decrease strength of the pressure levers 31A and 31 and the cam followers 32D, 32E, 32F, and 32G, respectively, and do not employ complex machining.

As described above, according to the third embodiment, the pressure levers 31A and 31 include the engagement that engages the engagement of the cam followers 32D, 32E, 32F, and 32G, attaining stable attachment of the cam followers 32D, 32E, 32F, and 32G to the pressure levers 31A and 31, like the second embodiment described above. Accordingly, the engagements prevent abnormal stress and load from being imposed on the cam followers 32D, 32E, 32F, and 32G and prevent failure such as early breakage of the cam followers 32D, 32E, 32F, and 32G. The cam followers 32D, 32E, 32F, and 32G are immune from failure such as dropping of parts at a time when the parts are assembled, in addition to a time when the fixing device 12 is used.

Referring to FIGS. 21, 22A, 22B, 22C, 23A, 23B, 23C, 23D, 24A, 24B, 25A, and 25B, a description is provided of a construction of a cam follower 32H and a pressure lever 31B according to a fourth embodiment of the present disclosure.

Figure 21:
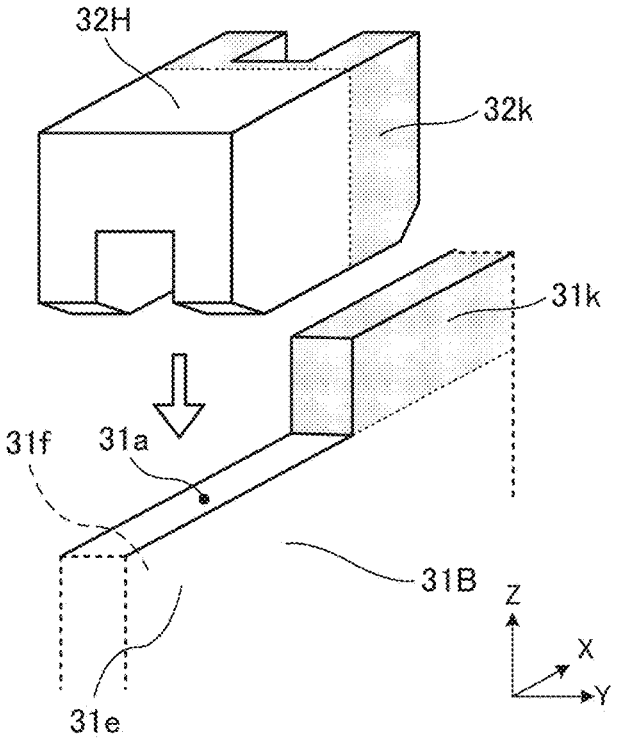
FIG. 21 is a perspective view of a pressure lever as another variation of the pressure lever depicted in FIG. 9 that includes a wall and a cam follower as yet another variation of the cam follower depicted in FIG. 9 that includes a wall engagement to engage the wall of the pressure lever.

As illustrated in FIG. 21, the pressure lever 31B includes a wall 31*k* projecting from the pressed face 31*a* that receives pressure from the cam 41. The wall 31*k* projects in an orthogonal direction (e.g., Z-direction) perpendicular to a thickness direction (e.g., Y-direction) of the pressure lever 31B. The cam follower 32H includes a wall engagement 32*k* that engages the wall 31*k* of the pressure lever 31B. Like the second embodiment described above, the cam follower 32H preferably engages the pressure lever 31B such that the cam follower 32H covers at least a part of the side faces 31*e* and 31*f* of the pressure lever 31B in the thickness direction thereof.

The cam follower 32H engages the pressed face 31*a* of the pressure lever 31B in the thickness direction (e.g., Y-direction) thereof. The cam follower 32H engages the wall 31*k* of the pressure lever 31B in the orthogonal direction (e.g., X-direction) perpendicular to the thickness direction of the pressure lever 31B. Accordingly, the cam follower 32H is attached to the pressure lever 31B more stably, preventing abnormal stress and load from being imposed on the cam follower 32H. Thus, the cam follower 32H is immune from failure such as early breakage.

Figure 22A:
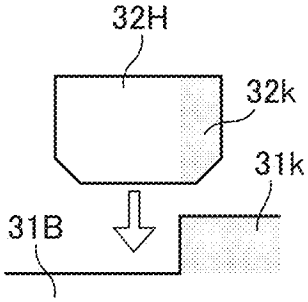
FIG. 22A is a diagram of the cam follower depicted in FIG. 21 to be attached to the pressure lever depicted in FIG. 21.
Figure 22B:
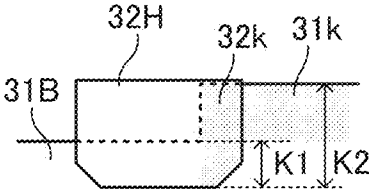
FIG. 22B is a diagram of the cam follower depicted in FIG. 22A that engages the pressure lever depicted in FIG. 22A.
Figure 22C:
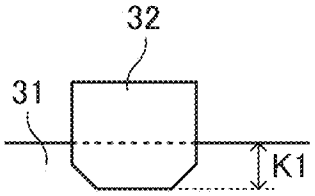
FIG. 22C is a diagram of the cam follower and the pressure lever depicted in FIG. 9.

FIG. 22A is a cross-sectional view of the cam follower 32H and the pressure lever 31B in X-direction depicted in FIG. 21. FIG. 22B is a cross-sectional view of the cam follower 32H attached to the pressure lever 31B. FIG. 22C is a cross-sectional view of the cam follower 32 and the pressure lever 31 according to the second embodiment illustrated for comparison.

As illustrated in FIG. 22B, the wall engagement 32*k* of the cam follower 32H overlaps the wall 31*k* of the pressure lever 31B for a length K2 greater than a length K1 vertically in FIG. 22B.

Figure 23A:
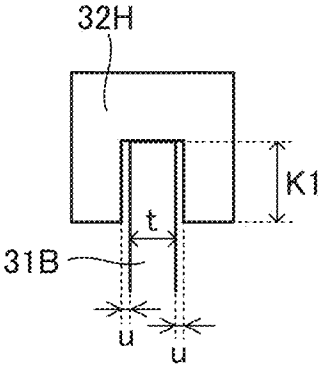
FIG. 23A is a diagram of the cam follower and the pressure lever depicted in FIG. 21, illustrating clearances therebetween.
Figure 23B:
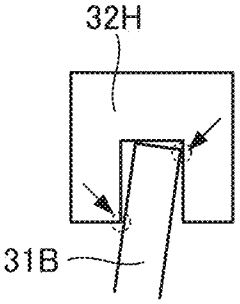
FIG. 23B is a diagram of the cam follower and the pressure lever depicted in FIG. 23A, illustrating inclination of the pressure lever caused by the clearances.
Figure 23C:
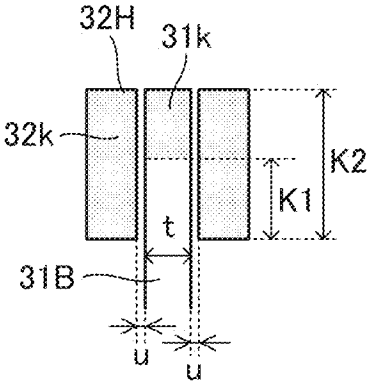
FIG. 23C is a diagram of the cam follower and the pressure lever, seen from a right side in FIG. 22B.
Figure 23D:
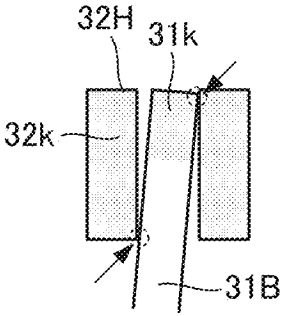
FIG. 23D is a diagram of the cam follower and the pressure lever depicted in FIG. 23C, illustrating inclination of the pressure lever.

Each of FIGS. 23A, 23B, 23C, and 23D is a cross-sectional view of the cam follower 32H and the pressure lever 31B depicted in FIGS. 21 and 22B in Y-direction depicted in FIG. 21, illustrating inclination in a posture of each of the pressure lever 31B and the cam follower 32H, which is caused by clearances u. Each of FIGS. 23A and 23B is a cross-sectional view of the cam follower 32H and the pressure lever 31B, seen from a left side in FIG. 22B. Each of FIGS. 23C and 23D is a cross-sectional view of the cam follower 32H and the pressure lever 31B, seen from a right side in FIG. 22B.

The cam follower 32H and the pressure lever 31B that engage each other preferably produce the clearances u therebetween that are decreased. If the clearances u are not provided between the cam follower 32H and the pressure lever 31B, the cam follower 32H and the pressure lever 31B may not operate properly. Hence, in view of variation in dimension of parts also, the cam follower 32H and the pressure lever 31B that engage each other preferably produce the clearances u therebetween that have a predetermined amount.

If the clearances u increase, the pressure lever 31B may incline as illustrated in FIGS. 23B and 23D. Accordingly, local stresses may be imposed on portions of the cam follower 32H and the pressure lever 31B, which are enclosed by dotted circles indicated with arrows, respectively, in FIGS. 23B and 23D. The lengths K1 and K2 extending vertically in FIGS. 23A and 23C, which indicate an overlap amount for which the cam follower 32H overlaps the pressure lever 31B, determine an amount of inclination of the pressure lever 31B.

As the overlap amount changes from the length K1 to the length K2, the amount of inclination of the pressure lever 31B decreases. As a result, the local stresses indicated with the arrows, respectively, in FIGS. 23B and 23D, also decrease.

Figure 24A:
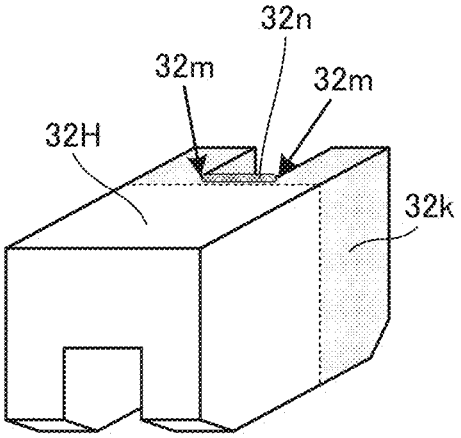
FIG. 24A is a perspective view of the cam follower depicted in FIG. 21, seen in one direction.
Figure 24B:
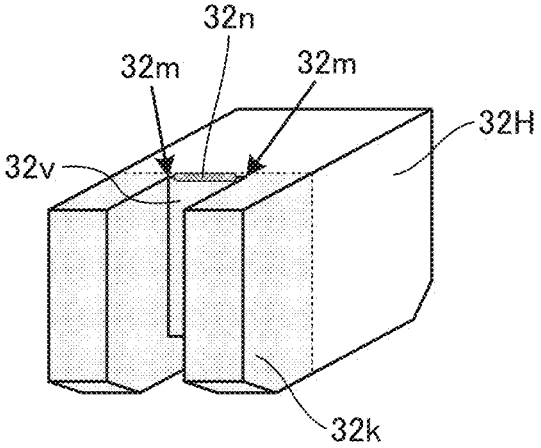
FIG. 24B is a perspective view of the cam follower depicted in FIG. 24A, seen in another direction.

Each of FIGS. 24A and 24B is a perspective view of the cam follower 32H according to the fourth embodiment. FIG. 24B illustrates the cam follower 32H seen from a rear section in FIG. 24A (e.g., the wall 31*k* of the pressure lever 31B in FIG. 21).

Figure 25A:
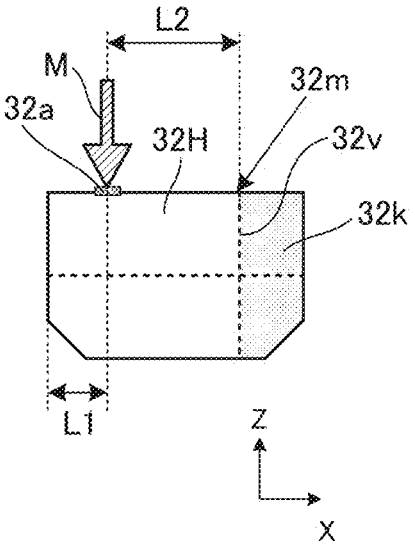
FIG. 25A is a side view of the cam follower depicted in FIG. 24A, illustrating dimensions thereof.
Figure 25B:
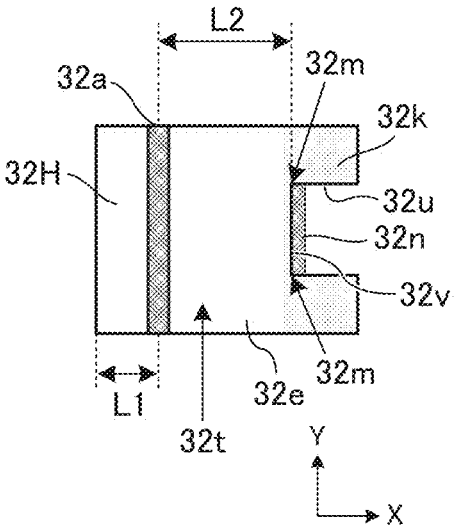
FIG. 25B is a top view of the cam follower depicted in FIG. 25A.

FIG. 25A is a cross-sectional view of the cam follower 32H according to the fourth embodiment in X-direction. FIG. 25B is a plan view of the cam follower 32H according to the fourth embodiment, illustrating the contact face 32*e* disposed opposite the cam 41.

According to the fourth embodiment, the contact face 32*e* of the cam follower 32H receives a load from the cam 41.

The contact face 32*e* includes a recess 32*u* that is substantially contoured into a U-shape in cross section in a horizontal direction in FIG. 25B by the wall engagement 32*k* that projects from a body 32*t* of the cam follower 32H. The recess 32*u* includes a bottom face having corners 32*m* at both ends of the bottom face in Y-direction, respectively. The wall engagement 32*k* includes a linear portion 32*n* defining a portion of the bottom face, that is other than the corners 32*m* disposed at upper end corners of the wall engagement 32*k* in FIG. 24B.

With the cam follower 32H according to the fourth embodiment, simulation for analyzing stress for combination of the length Δt and the length L was performed like the simulation depicted in FIG. 15.

The length L served as a threshold for deviation of the load stress St from the load stress Sc as the load stresses Sc and St varied depending on the length Δt. At the upper end corners of the wall engagement 32*k*, the length L varied between the corners 32*m* and the linear portion 32*n*. The length L at the corner 32*m* was greater than the length L at the linear portion 32*n*.

Figure 26:
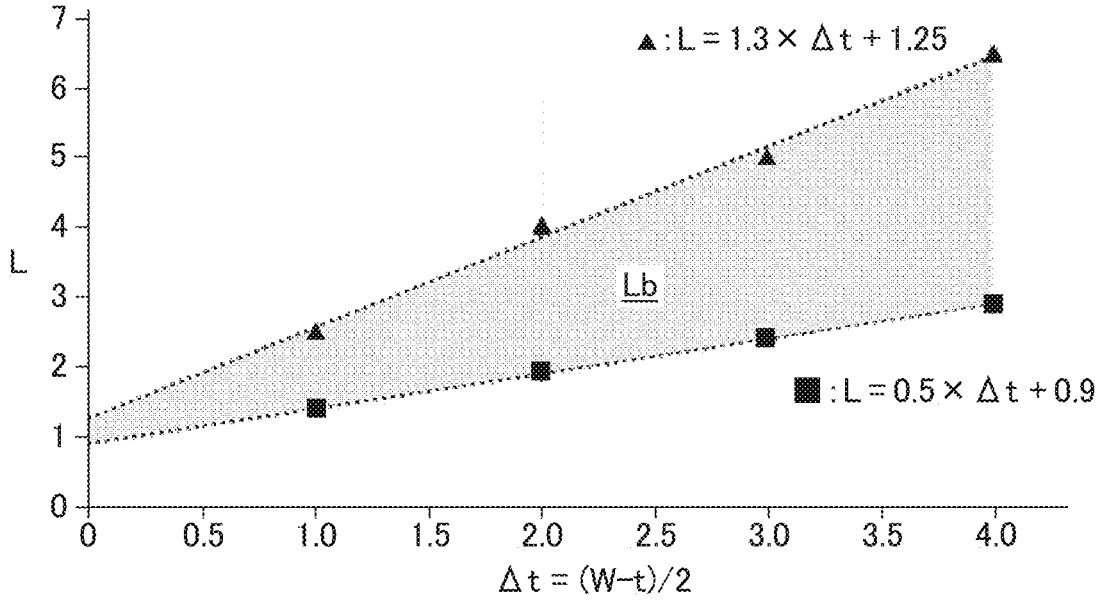
FIG. 26 is a graph illustrating results of simulation for analyzing stress for combination of the length Δt and the length L of the cam follower depicted in FIG. 25B.
Figure 27:
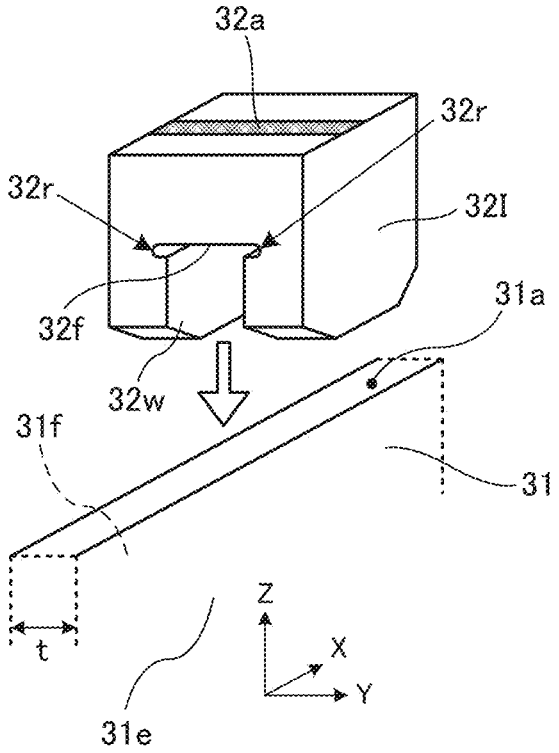
FIG. 27 is a perspective view of a cam follower as yet another variation of the cam follower depicted in FIG. 9, to be attached to the pressure lever.

FIG. 26 is a graph illustrating results of the simulation.

FIG. 26 illustrates a horizontal axis representing the length Δt defined by (W−t)/2 and a vertical axis representing the length L. The graph illustrates results plotted with rectangular spots that indicate values of the length L where the load stress St starts deviating from the load stress Sc. The rectangular spots create a line indicated by an approximation formula, that is, a formula (5) below.

$$L=0.5\times\Delta t+0.9 \quad (5)$$

FIG. 26 illustrates an area Lb that is enclosed by a line defined by the formula (3) and a line defined by the formula (5) and indicates a proper range of the length Δt.

In designing the cam follower 32H, if the length Δt is determined based on the thickness t of the pressure lever 31B constructed of the sheet metal that is platy, the contact position 32*a* where the cam follower 32H contacts the cam 41 is set at a position defining a length from a wall opposed side face 32*v* of the cam follower 32H depicted in FIG. 24B. The wall opposed side face 32*v* is disposed opposite the wall 31*k* of the pressure lever 31B in the orthogonal direction perpendicular to the thickness direction of the pressure lever 31B. The length is greater than the length L calculated according to the formula (5). Thus, the cam follower 32H is immune from a crack.

The wall opposed side face 32*v* of the cam follower 32H is disposed opposite or in contact with the wall 31*k* in a state in which the cam follower 32H is attached to the pressure lever 31B.

For example, as illustrated in FIG. 25B, the contact face 32*e* has the length L2 in the orthogonal direction (e.g., X-direction) perpendicular to the thickness direction of the pressure lever 31B. The length L2 is defined from the contact position 32*a* where the cam follower 32H contacts the cam 41 to the wall opposed side face 32*v* of the cam follower 32H, which is disposed opposite the wall 31*k* of the pressure lever 31B. The length L2 is defined by a formula (6) below.

$$L2>0.5\times(W-t)/2+0.9 \quad (6)$$

Thus, the cam follower 32H is immune from a crack at the corners 32*m*.

Similarly, the formula (5) considers the length Δt as the variable. Hence, a proper shape of the cam follower 32H is determined in view of a relation to the contact position 32*a* where the cam follower 32H contacts the cam 41. Based on the determined proper shape of the cam follower 32H, a material of the cam follower 32H and an amount of stress received by the cam follower 32H from the cam 41 are considered. Accordingly, a material that achieves an enhanced strength of the cam follower 32H unnecessarily is not selected and used, preventing increase in manufacturing costs.

Referring to FIGS. 27, 28A, 28B, and 28C, a description is provided of a construction of each of cam followers 321, 32J, and 32K according to a fifth embodiment of the present disclosure.

Figure 28A:
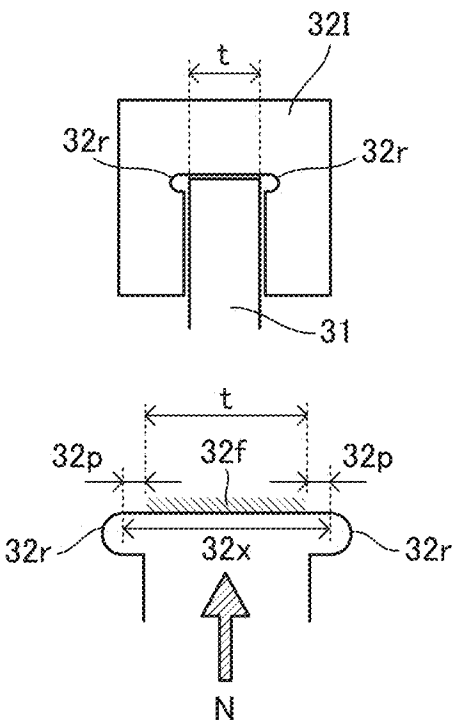
FIG. 28A is a diagram of the cam follower depicted in FIG. 27, illustrating grooves thereof and stress applied to the cam follower.
Figure 28B:
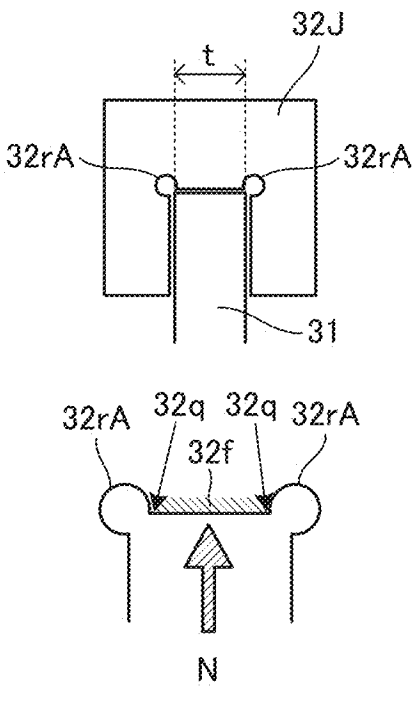
FIG. 28B is a diagram of a cam follower as yet another variation of the cam follower depicted in FIG. 9, illustrating round portions thereof and stress applied to the cam follower.
Figure 28C:
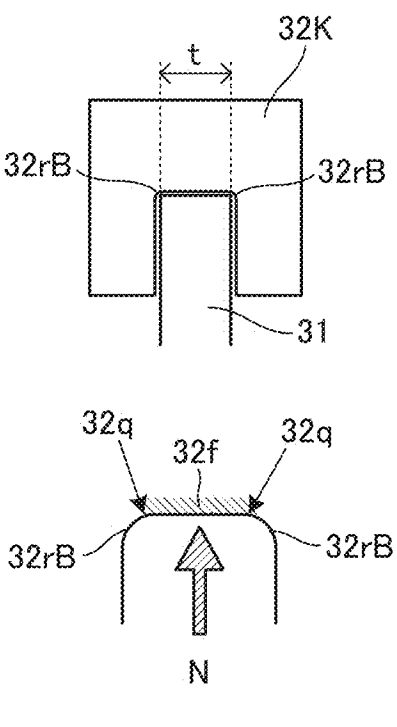
FIG. 28C is a diagram of a cam follower as yet another variation of the cam follower depicted in FIG. 9, illustrating round corners thereof and stress applied to the cam follower.

FIGS. 28A, 28B, and 28C include cross-sectional views illustrating the cam followers 321, 32J, and 32K that engage the pressure lever 31 in upper sections in FIGS. 28A, 28B, and 28C, respectively. FIGS. 28A, 28B, and 28C further include enlarged views illustrating contact portions of the cam followers 321, 32J, and 32K that contact the pressure lever 31 in lower sections in FIGS. 28A, 28B, and 28C, respectively.

As illustrated in FIGS. 27, 28A, 28B, and 28C, the pressure lever 31 includes the pressed face 31*a* and the side faces 31*e* and 31*f*. The pressed face 31*a* receives pressure from the cam 41. The cam follower 321 includes a recess 32*w* that engages the pressure lever 31 such that the cam follower 321 covers at least a part of the side faces 31*e* and 31*f* of the pressure lever 31 in the thickness direction thereof. The recess 32*w* includes the contact portion 32*f* (e.g., the bottom face) that contacts the pressed face 31*a*. The contact portion 32*f* preferably abuts on grooves 32*r* that project from both ends of the contact portion 32*f*, respectively, horizontally in FIG. 28A in Y-direction in FIG. 27, that is, the thickness direction of the pressure lever 31. Each of the grooves 32*r* is round.

Like the cam follower 32 according to the second embodiment described above, the cam follower 321 is substantially lateral U-shaped in cross section. With the cam follower 321 that is substantially lateral U-shaped, the contact portion 32*f* (e.g., the bottom face of the recess 32*w*) that contacts the pressure lever 31 may receive increased stress at corners of the contact portion 32*f*. Thus, the corners of the contact portion 32*f* are subject to breakage. In order to decrease stress imposed on the corners of the contact portion 32*f*, the corners of the contact portion 32*f* may be round. However, the corners that are round may not decrease stress imposed on the contact portion 32*f* and may generate other disadvantage.

FIG. 28C illustrates the cam follower 32K including round corners 32*r*B that abut on both ends of the contact portion 32*f* (e.g., the bottom face) of the recess 32*w*. Simulation for analyzing stress was performed on the cam follower 32K depicted in FIG. 28C. As a result, the cam follower 32K having the round corners 32*r*B decreased stress by approximately 30 percent compared to a cam follower not machined to have the round corners 32*r*B.

However, with the cam follower 32K depicted in FIG. 28C, the pressed face 31*a* of the pressure lever 31 has corners that interfere with the round corners 32*r*B of the cam follower 32K. To address this circumstance, the recess 32*w* of the cam follower 32K, that engages the pressure lever 31, may have an increased width. However, like the cam follower 32H and the pressure lever 31B depicted in FIGS. 23A and 23B, the cam follower 32K and the pressure lever 31 may not stabilize posture easily. Further, as illustrated in FIG. 28C, the cam follower 32K may receive increased stress at both ends 32*q* of the contact portion 32*f* that contacts the pressure lever 31. Thus, the cam follower 32K is subject to breakage.

FIG. 28B illustrates the cam follower 32J including round portions 32*r*A that project upward in FIG. 28B from both ends of the contact portion 32*f* (e.g., the bottom face) of the recess 32*w*. Simulation for analyzing stress was performed on the cam follower 32J depicted in FIG. 28B. As a result, like the cam follower 32K depicted in FIG. 28C, the cam follower 32J having the round portions 32*r*A decreased stress by approximately 30 percent compared to a cam follower not machined to have the round portions 32*r*A.

However, with the cam follower 32J depicted in FIG. 28B, although the cam follower 32J does not interfere with the corners of the pressed face 31*a* of the pressure lever 31, the cam follower 32J may receive increased stress at both ends 32*q* of the contact portion 32*f* that contacts the pressure lever 31. Thus, the cam follower 32J is subject to breakage.

FIG. 28A illustrates the cam follower 32I including the grooves 32*r* that project horizontally in FIG. 28A from both ends of the contact portion 32*f* (e.g., the bottom face) of the recess 32*w*, respectively. Each of the grooves 32*r* is semicircular. For example, each of the grooves 32*r* is a recess or a retraction.

Since the cam follower 32I includes the grooves 32*r* that are semicircular, the pressed face 31*a* of the pressure lever 31 contacts the contact portion 32*f* of the cam follower 321 with a proper clearance between each of the side faces 31*e* and 31*f* of the pressure lever 31 and the recess 32*w* of the cam follower 32I and with a proper width of the recess 32*w*. Thus, the cam follower 321 and the pressure lever 31 stabilize posture that attains a proper positional relation between the cam follower 32I and the pressure lever 31.

As illustrated in a lower section in FIG. 28A, the cam follower 321 includes planar portions 32*p* that extend horizontally in FIG. 28A from both ends of the contact portion 32*f* that contacts the pressure lever 31, respectively. The contact portion 32*f* and the planar portions 32*p* define a bottom face 32*x* of the recess 32*w*, that has a length greater than the thickness t of the pressure lever 31. Accordingly, the contact portion 32*f* and the planar portions 32*p* prevent a local part (e.g., both ends 32*q* of the contact portion 32*f* depicted in FIG. 28B) from being exerted with increased stress.

Simulation for analyzing stress was performed on the cam follower 321 depicted in FIG. 28A. As a result, the cam follower 321 having the planar portions 32*p* decreased stress by 84 percent compared to a cam follower not machined to have the planar portions 32*p*. The contact portion 32*f* and the planar portions 32*p* cause the bottom face 32*x* of the recess 32*w* to have an increased width, preventing stress from being concentrated on the local part of the bottom face 32*x*. Thus, the cam follower 321 retains decreased stress on an entirety of the bottom face 32*x* of the recess 32*w*. Hence, the cam follower 321 according to the fifth embodiment preferably includes the planar portions 32*p* and the grooves 32*r* as illustrated in FIG. 28A. As described above, the planar portions 32*p* and the grooves 32*r* decrease load stress imposed on both ends 32*q* of the recess 32*w*, that are subject to a crack, thus preventing early breakage of parts of the cam follower 321 and improving durability of the cam follower 321.

Referring to FIGS. 29A, 29B, 29C, 29D, 30B, 30C, 30E, and 30F, a description is provided of a construction of each of cam followers 32L, 32M, 32N, and 32P according to a sixth embodiment of the present disclosure.

Figure 29A:
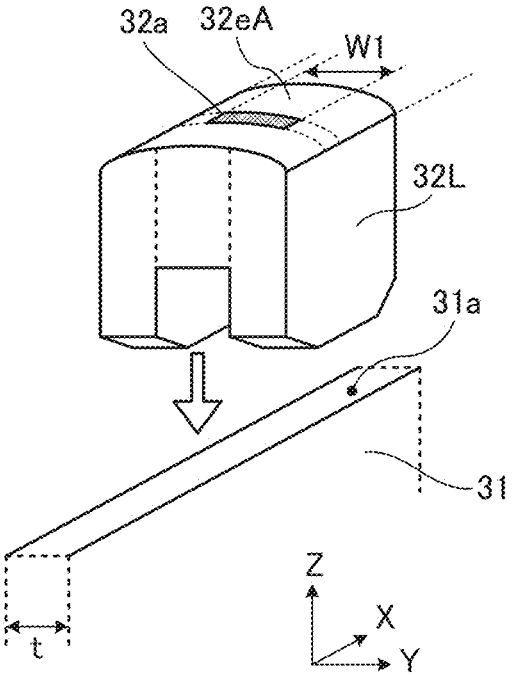
FIG. 29A is a perspective views of a cam follower as yet another variation of the cam follower depicted in FIG. 9, illustrating a contact face thereof that contacts the cam.
Figure 29B:
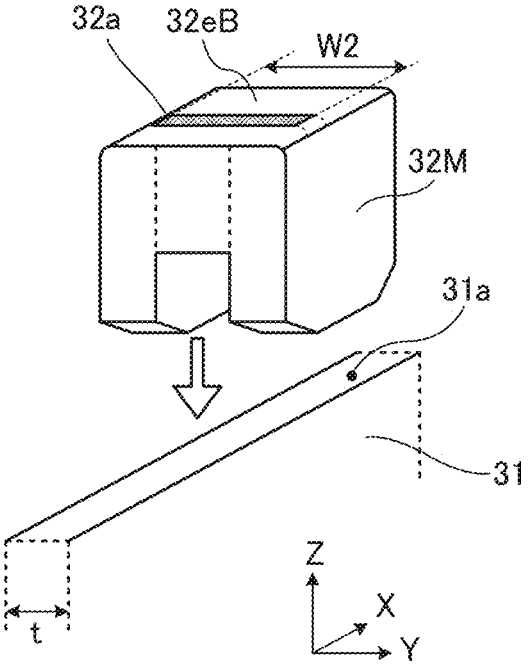
FIG. 29B is a perspective views of a cam follower as yet another variation of the cam follower depicted in FIG. 9, illustrating a contact face thereof as a variation of the contact face depicted in FIG. 29A.
Figure 29C:
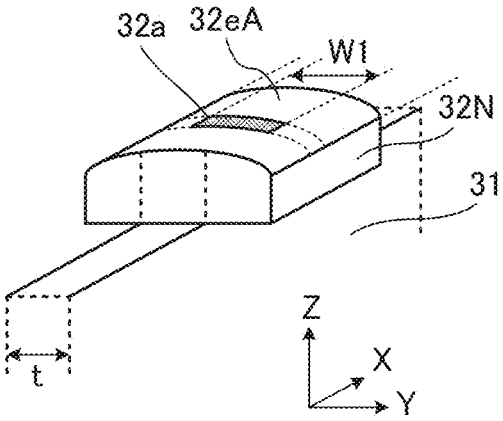
FIG. 29C is a perspective views of a cam follower as yet another variation of the cam follower depicted in FIG. 9, illustrating the contact face thereof depicted in FIG. 29A.
Figure 29D:
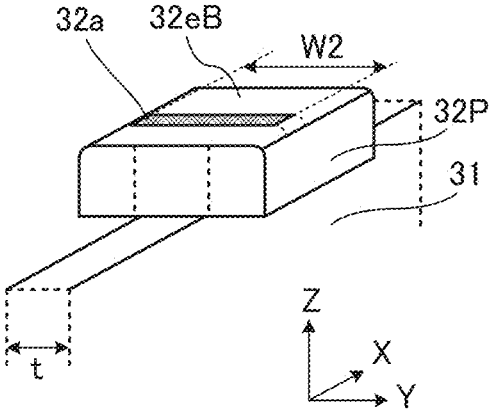
FIG. 29D is a perspective views of a cam follower as yet another variation of the cam follower depicted in FIG. 9, illustrating the contact face thereof depicted in FIG. 29B.

FIGS. 29A, 29B, 29C, and 29D are perspective views of the cam followers 32L, 32M, 32N, and 32P, respectively, illustrating contact faces 32*e*A and 32*e*B that contact the cam 41. As illustrated in FIGS. 29A and 29C, each of the cam followers 32L and 32N includes the contact face 32*e*A disposed opposite the cam 41. As illustrated in FIGS. 29B and 29D, each of the cam followers 32M and 32P includes the contact face 32*e*B disposed opposite the cam 41. Each of the contact faces 32*e*A and 32*e*B is formed in substantially an arc in cross section in the thickness direction (e.g., Y-direction) of the pressure lever 31. The arc projects toward the cam 41.

As illustrated in FIGS. 29A and 29C, the contact face 32*e*A disposed opposite the cam 41 includes a center in Y-direction that projects toward the cam 41. Accordingly, compared to the contact face 32*e* depicted in FIG. 9 that is planar throughout an entirety of the contact face 32*e* disposed opposite the cam 41, the contact face 32*e*A contacts the cam 41 in a contact region having a length W1 in Y-direction that is smaller than the length W depicted in FIG. 9.

As illustrated in FIGS. 29B and 29D, the contact face 32*e*B disposed opposite the cam 41 includes both ends in Y-direction that are round. Accordingly, like the contact face 32*e*A depicted in FIGS. 29A and 29C, compared to the contact face 32*e* depicted in FIG. 9 that is planar, the contact face 32*e*B contacts the cam 41 in a contact region having a length W2 in Y-direction that is smaller than the length W depicted in FIG. 9.

The lengths W1 and W2 that are smaller than the length W decrease the length Δt. Accordingly, the lengths L calculated by the formulas (2), (3), and (5) described above, respectively, also decrease. Thus, the cam followers 32L, 32M, 32N, and 32P are immune from a crack with the decreased lengths L.

However, with the lengths W1 and W2 that are decreased, the contact faces 32*e*A and 32*e*B may contact the cam 41 in the decreased contact regions having the lengths W1 and W2, respectively, with increased pressure. Accordingly, the cam followers 32L, 32M, 32N, and 32P may cope with early breakage caused by the increased pressure and abrasion caused by the cam 41.

Figure 30A:
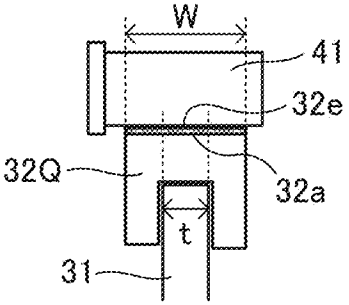
FIG. 30A is a cross-sectional view of a cam follower as a comparative example, illustrating a contact face thereof that contacts the cam.
Figure 30B:
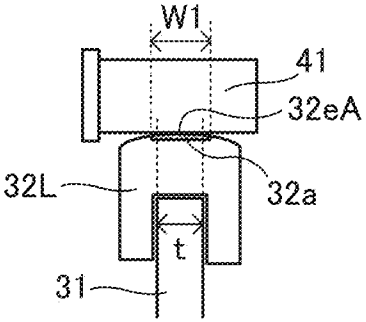
FIG. 30B is a cross-sectional view of the cam follower depicted in FIG. 29A.
Figure 30C:
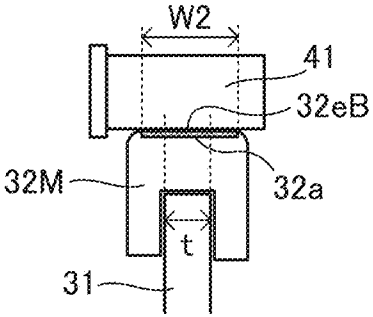
FIG. 30C is a cross-sectional view of the cam follower depicted in FIG. 29B.
Figure 30D:
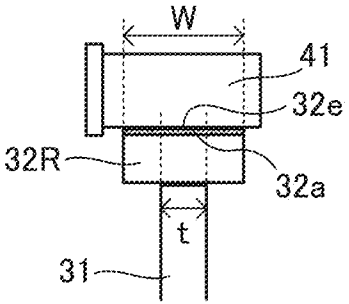
FIG. 30D is a cross-sectional view of a cam follower as another comparative example, illustrating a contact face thereof that contacts the cam.
Figure 30E:
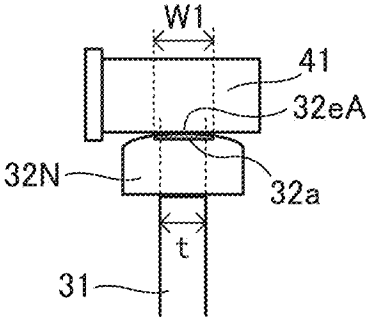
FIG. 30E is a cross-sectional view of the cam follower depicted in FIG. 29C.
Figure 30F:
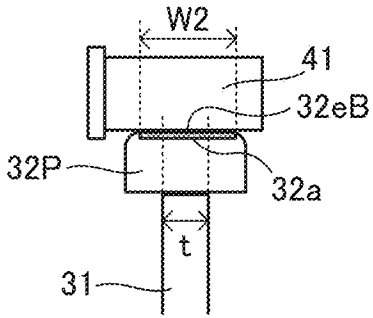
FIG. 30F is a cross-sectional view of the cam follower depicted in FIG. 29D.

Each of FIGS. 30A, 30B, 30C, 30D, 30E, and 30F is a cross-sectional view in Y-direction of the cam 41, a cam follower (e.g., the cam followers 32L, 32M, 32N, and 32P and cam followers 32Q and 32R) that contacts the cam 41, and the pressure lever 31 that contacts the cam follower. FIG. 30B illustrates the cam follower 32L depicted in FIG. 29A. FIG. 30C illustrates the cam follower 32M depicted in FIG. 29B. FIG. 30E illustrates the cam follower 32N depicted in FIG. 29C. FIG. 30F illustrates the cam follower 32P depicted in FIG. 29D. FIGS. 30A and 30D illustrate the cam followers 32Q and 32R, respectively, that have the contact face 32*e* that is disposed opposite the cam 41 and is planar, as comparative examples.

As illustrated in FIGS. 30B and 30E, each of the cam followers 32L and 32N includes the contact face 32*e*A that is disposed opposite the cam 41. As illustrated in FIGS. 30C and 30F, each of the cam followers 32M and 32P includes the contact face 32*e*B that is disposed opposite the cam 41. Each of the contact faces 32*e*A and 32*e*B projects toward the cam 41. For example, each of the contact faces 32*e*A and 32*e*B is substantially the arc that projects toward the cam 41. Hence, the contact face 32*e*A contacts the cam 41 in the contact region having the length W1 in Y-direction (e.g., the thickness direction of the pressure lever 31) that is smaller than the length W of the cam followers 32Q and 32R depicted in FIGS. 30A and 30D, respectively. The contact face 32*e*B contacts the cam 41 in the contact region having the length W2 in Y-direction that is smaller than the length W of the cam followers 32Q and 32R depicted in FIGS. 30A and 30D, respectively.

As illustrated in FIGS. 30B and 30E, each of the cam followers 32L and 32N is substantially the arc that projects toward the cam 41. Theoretically, each of the cam followers 32L and 32N contacts the cam 41 at a center of the contact region where each of the cam followers 32L and 32N contacts the cam 41. However, since the cam followers 32L and 32N are made of resin, the length W1 in Y-direction of the contact region on the contact face 32*e*A that contacts the cam 41 may vary depending on rigidity, abrasion, and the like of the cam followers 32L and 32N. However, the length W1 is smaller than the length W of the contact region on the contact face 32*e* that is planar and in contact with the cam 41 as illustrated in FIGS. 30A and 30D. Thus, the cam followers 32L and 32N achieve advantages of the length W1 that is smaller than the length W.

The fixing device 12 according to the embodiments of the present disclosure adjusts pressure applied by the pressure roller 19 with the pressing device 30 described above. Adjustment of pressure applied by the pressure roller 19 is not limited to adjustment according to a type of a sheet P. For example, the pressing device 30 may perform adjustment to decrease pressure applied by the pressure roller 19 so as to facilitate removal of the sheet P jammed at the fixing nip 80 or to decrease pressure applied by the pressure roller 19 after the sheet P passes through the fixing nip 80 so as to suppress plastic deformation of the pressure roller 19 and the fixing roller 18 due to pressure. Alternatively, the pressing device 30 may release pressure such that the pressure roller 19 separates from the fixing roller 18 and does not contact the fixing roller 18.

The embodiments of the present disclosure are also applied to fixing devices other than the fixing device 12 incorporating a pair of rollers (e.g., the fixing roller 18 and the pressure roller 19) as illustrated in FIG. 2.

Figure 31:
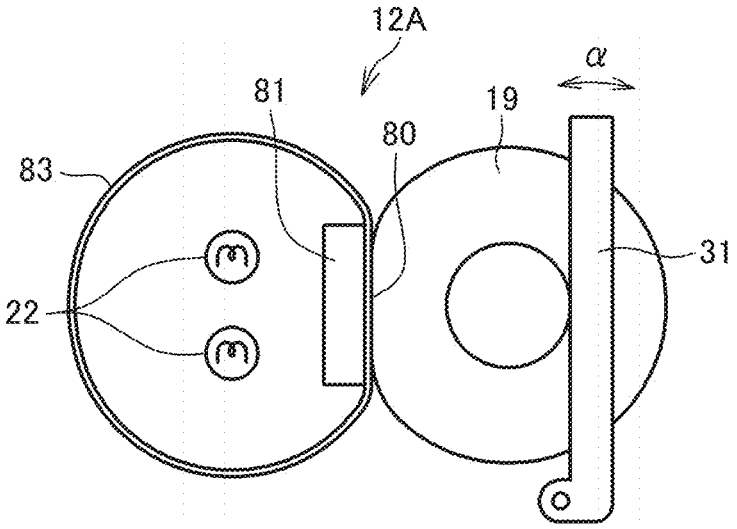
FIG. 31 is a schematic cross-sectional view of a fixing device incorporating a fixing belt, as a variation of the fixing device depicted in FIG. 2.

For example, as illustrated in FIG. 31, the embodiments of the present disclosure are also applied to a fixing device 12A incorporating an endless fixing belt 83 instead of the fixing roller 18. As illustrated in FIG. 31, the fixing device 12A includes the heaters 22 and a nip formation pad 81 that are disposed opposite an inner circumferential surface of the fixing belt 83. As the pressure lever 31 that pivots in the pivot direction a presses the pressure roller 19 against the nip formation pad 81 via the fixing belt 83, the fixing nip 80 is formed between the fixing belt 83 and the pressure roller 19.

The embodiments of the present disclosure are also applied to fixing devices other than the fixing device 12 incorporating the pressure roller 19 that comes into contact with and separates from the fixing roller 18 as illustrated in FIG. 2.

Figure 32:
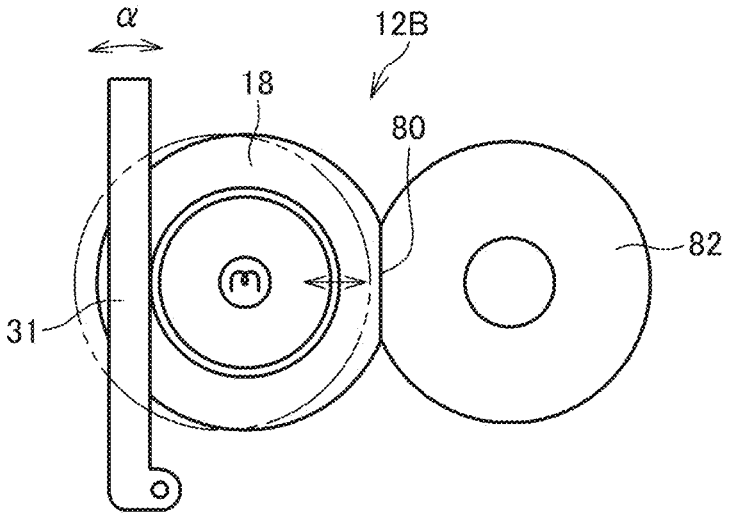
FIG. 32 is a schematic cross-sectional view of a fixing device incorporating a fixing roller that comes into contact with and separates from an opposed roller, as another variation of the fixing device depicted in FIG. 2.

For example, as illustrated in FIG. 32, the embodiments of the present disclosure are also applied to a fixing device 12B in which the pressure lever 31 that pivots in the pivot direction a brings the fixing roller 18 into contact with an opposed roller 82 disposed opposite the fixing roller 18 to form the fixing nip 80 between the fixing roller 18 and the opposed roller 82 and separates the fixing roller 18 from the opposed roller 82.

The pressing device 30 according to the embodiments of the present disclosure may be applied to a transfer device that transfers an image onto a recording medium such as a sheet in addition to the fixing device 12.

A description is provided of advantages of a fixing device (e.g., the fixing devices 12, 12A, and 12B).

As illustrated in FIGS. 2 and 9, the fixing device includes a pair of rotators (e.g., the pressure roller 19 and the fixing roller 18), a pressure lever (e.g., the pressure lever 31), a support shaft (e.g., the support shaft 33), a resilient member (e.g., the pressure spring 36), a cam (e.g., the cam 41), and a cam follower (e.g., the cam followers 32, 32A, 32D, 32E, 32F, 32G, 32H, 32I, 32L, 32M, 32N, and 32P).

The pair of rotators includes a first rotator and a second rotator that separably press against each other. The second rotator comes into contact with the first rotator and separates from the first rotator. The first rotator and the second rotator sandwich and convey a recording medium (e.g., the sheet P). The pressure lever includes one end (e.g., the supported end 31*d*) that is supported by the support shaft. The pressure lever further includes another end (e.g., the biased end 31*b*) that engages the resilient member. The pressure lever is platy and pivots to press one of the pair of rotators, that is, the second rotator, against another one of the pair of rotators, that is, the first rotator. The cam moves the pressure lever between a pressing position where the second rotator presses against the first rotator and a pressure release position where the second rotator releases pressure applied to the first rotator. The cam follower is mounted on the pressure lever and disposed opposite the cam. The cam follower transmits pressure from the cam to the pressure lever. The pressure lever has a thickness t. The cam follower has a contact face (e.g., the contact face 32*e*) that contacts the cam and a side face (e.g., the side face 32*c*) that is perpendicular to the contact face and serves as one of four side faces of the cam follower. The contact face has a length W in a thickness direction (Y-direction depicted in FIG. 9) of the pressure lever. The contact face of the cam follower has a length L1 in an orthogonal direction (e.g., X-direction depicted in FIG. 9) perpendicular to the thickness direction of the pressure lever. The length L1 is defined from a contact position (e.g., the contact position 32*a*) where the cam follower contacts the cam to the side face of the cam follower. The thickness t, the length W, and the length L1 satisfy a relation defined by $L1 \geq 0.6 \times (W-t)/2+0.2$.

Accordingly, the fixing device prevents breakage of the cam follower while saving space and reducing costs.

According to the embodiments described above, the fixing roller 18 serves as a first rotator. Alternatively, a fixing belt, a fixing film, a fixing sleeve, or the like may be used as a first rotator. Further, the pressure roller 19 serves as a second rotator. Alternatively, a pressure belt or the like may be used as a second rotator.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

The invention claimed is:

1. A pressing device comprising:

a pressure lever that is platy and has a thickness t, the pressure lever configured to pivot;

a cam configured to press the pressure lever; and a cam follower mounted on the pressure lever and disposed opposite the cam, the cam follower configured to transmit pressure from the cam to the pressure lever, the cam follower having a contact face configured to contact the cam and a side face being perpendicular to the contact face, the contact face having a length W in a thickness direction of the pressure lever and a length L1 in an orthogonal direction perpendicular to the thickness direction of the pressure lever, the length L1 defined from a contact position where the cam follower contacts the cam to the side face of the cam follower, the thickness t, the length W, and the length L1 satisfying a relation defined by $$L1 \geq 0.6 \times (W-t)/2+0.2.$$

2. The pressing device according to claim 1, further comprising:

a support shaft configured to support one end of the pressure lever; and a resilient member configured to engage another end of the pressure lever.

3. The pressing device according to claim 2, wherein the resilient member includes a spring.

4. The pressing device according to claim 1, wherein the thickness t, the length W, and the length L1 satisfy a relation defined by $$L1 < 1.3 \times (W-t)/2+1.25.$$

5. The pressing device according to claim 1, wherein the side face of the cam follower is perpendicular to the thickness direction of the pressure lever, and wherein the cam follower includes a corner that is defined by the contact face and the side face and is round.

6. The pressing device according to claim 1, wherein the cam follower is substantially lateral U-shaped in cross section.

7. The pressing device according to claim 6, wherein the pressure lever has a pressed face configured to receive the pressure from the cam through the cam follower and a plurality of side faces disposed opposite each other in the thickness direction of the pressure lever, and wherein the cam follower is configured to engage the pressure lever and cover at least a part of the pressed face and the plurality of side faces of the pressure lever.

8. The pressing device according to claim 7, wherein the pressure lever includes a wall projecting from the pressed face in an orthogonal direction perpendicular to the pressed face, and wherein the cam follower includes a wall engagement configured to engage the wall of the pressure lever.

9. The pressing device according to claim 8, wherein the cam follower further has a wall opposed side face disposed opposite the wall of the pressure lever, wherein the cam follower has a length L2 in the orthogonal direction perpendicular to the thickness direction of the pressure lever, wherein the length L2 is defined from the contact position where the cam follower contacts the cam to the wall opposed side face of the cam follower, and wherein the length L2 satisfies a relation defined by $L2 \geq 0.5 \times (W-t)/2+0.9$.

10. The pressing device according to claim 7, wherein the cam follower includes a recess configured to engage the pressure lever and cover at least a part of the pressed face and the plurality of side faces of the pressure lever.

11. The pressing device according to claim 10, wherein the recess includes:

a contact portion configured to contact the pressed face of the pressure lever; and a groove projecting from each end of the contact portion in the thickness direction of the pressure lever, the groove being round.

12. The pressing device according to claim 11, wherein the recess further includes a plurality of planar portions extending from both ends of the contact portion, respectively, and wherein the contact portion and the plurality of planar portions define a bottom face of the recess, the bottom face having a length greater than the thickness t of the pressure lever.

13. The pressing device according to claim 1, wherein the cam follower includes a first engagement and the pressure lever includes a second engagement configured to engage the first engagement of the cam follower.

14. The pressing device according to claim 1, wherein the contact face of the cam follower is formed in substantially an arc in cross section in the thickness direction of the pressure lever, the arc projecting toward the cam.

15. A fixing device comprising:

a first rotator;

a second rotator configured to separably press against the first rotator, the first rotator and the second rotator configured to sandwich and convey a recording medium;

a pressure lever that is platy and has a thickness t, the pressure lever configured to pivot, the pressure lever configured to press the second rotator against the first rotator;

a cam configured to press and move the pressure lever between a pressing position where the second rotator presses against the first rotator and a pressure release position where the second rotator releases pressure applied to the first rotator; and a cam follower mounted on the pressure lever and disposed opposite the cam, the cam follower configured to transmit pressure from the cam to the pressure lever, the cam follower having a contact face configured to contact the cam and a side face being perpendicular to the contact face, the contact face having a length W in a thickness direction of the pressure lever and a length L1 in an orthogonal direction perpendicular to the thickness direction of the pressure lever, the length L1 defined from a contact position where the cam follower contacts the cam to the side face of the cam follower, the thickness t, the length W, and the length L1 satisfying a relation defined by $$L1 \geq 0.6 \times (W-t)/2+0.2.$$

16. The fixing device according to claim 15, wherein each of the first rotator and the second rotator includes a roller.

17. An image forming apparatus comprising:

an image bearer configured to bear an image; and a fixing device configured to fix the image on a recording medium, the fixing device including:

a first rotator;

a second rotator configured to separably press against the first rotator, the first rotator and the second rotator configured to sandwich and convey the recording medium;

a pressure lever that is platy and has a thickness t, the pressure lever configured to pivot, the pressure lever configured to press the second rotator against the first rotator;

a cam configured to press and move the pressure lever between a pressing position where the second rotator presses against the first rotator and a pressure release position where the second rotator releases pressure applied to the first rotator; and a cam follower mounted on the pressure lever and disposed opposite the cam, the cam follower configured to transmit pressure from the cam to the pressure lever, the cam follower having a contact face configured to contact the cam and a side face being perpendicular to the contact face, the contact face having a length W in a thickness direction of the pressure lever and a length L1 in an orthogonal direction perpendicular to the thickness direction of the pressure lever, the length L1 defined from a contact position where the cam follower contacts the cam to the side face of the cam follower, the thickness t, the length W, and the length L1 satisfying a relation defined by $L1 \geq 0.6 \times (W-t)/2+0.2$.

* * * * *